US005585143A

United States Patent [19]

Scharf et al.

[11] Patent Number: 5,585,143

[45] Date of Patent: Dec. 17, 1996

[54] APPARATUS AND METHODS FOR APPLYING SOLVENT-FREE LIQUIFIED COATINGS IN A RECLAIM SPACE

[75] Inventors: Donald R. Scharf, Amherst; Douglas J. Conrad, Lorain; Kenneth J. Coeling, Westlake, all of Ohio

[73] Assignee: Nordson Corporation, Westlake, Ohio

[21] Appl. No.: 277,510

[22] Filed: Jul. 19, 1994

Related U.S. Application Data

[63] Continuation-in-part of Ser. No. 705,516, May 24, 1991, abandoned.

[51] Int. Cl.[6] ..... B05D 3/08

[52] U.S. Cl. ..... 427/224; 427/290; 427/292; 427/314; 427/345; 427/348; 427/375; 427/422; 427/424; 118/63; 118/68; 118/72; 118/302; 118/315; 118/316; 118/326; 118/DIG. 7; 118/DIG. 11

[58] Field of Search ..... 427/314, 345, 427/348, 422, 424, 375, 224, 290, 292; 118/63, 68, 72, 315, 316, 326, 302, DIG. 11, DIG. 7

[56] References Cited

U.S. PATENT DOCUMENTS

| | | | |
|---|---|---|---|
| 1,672,736 | 6/1928 | Skinner | 118/326 |
| 1,792,414 | 2/1931 | Cole | 118/67 |
| 2,217,724 | 10/1940 | Birmingham | 91/44 |
| 2,400,315 | 5/1946 | Paasche | 118/324 |
| 2,741,218 | 4/1956 | Miller | 118/326 |
| 2,763,575 | 9/1956 | Bede | 118/302 |
| 3,070,457 | 12/1962 | Labombarde | 427/224 |
| 3,407,099 | 10/1968 | Schell | 427/424 |
| 3,570,725 | 3/1971 | Baker et al. | 222/504 |
| 3,802,908 | 4/1974 | Emmons | 118/314 |
| 3,875,899 | 4/1975 | Clements | 118/DIG. 7 |
| 3,911,161 | 10/1975 | Nord et al. | 427/375 |
| 4,070,503 | 1/1978 | Robert et al. | 427/195 |
| 4,073,409 | 2/1978 | Gardner et al. | 222/260 |
| 4,136,463 | 1/1979 | Nolan et al. | 118/DIG. 7 |
| 4,182,782 | 1/1980 | Scheiber | 118/DIG. 11 |
| 4,227,069 | 10/1980 | Gardner et al. | 219/421 |
| 4,240,567 | 12/1980 | Gardner | 418/171 |
| 4,304,822 | 12/1981 | Heyl | 427/349 |
| 4,537,610 | 8/1985 | Armstrong et al. | 427/375 |
| 4,568,400 | 2/1986 | Patterson Jr. et al. | 156/48 |
| 5,026,451 | 6/1991 | Trzecieski et al. | 156/244.27 |
| 5,053,254 | 10/1991 | Billeter | 427/348 |
| 5,371,972 | 12/1994 | McConkey et al. | 451/62 |

FOREIGN PATENT DOCUMENTS

| | | |
|---|---|---|
| 555124 | 4/1958 | Canada . |
| 4125430 | 3/1992 | Germany . |
| 1328151 | 8/1973 | United Kingdom . |

OTHER PUBLICATIONS

Nordson Brochure, "Continuous Coater" 6 pages, 306–18–671 revised 1988 (no month date).

Patent Abstracts of Japan, "Abstract No. 92304476.2" vol. 3, No. 75 (no date).

Patent Abstracts of Japan, "Application No. 54–050053" Apr. 1979.

*Primary Examiner*—Katherine Bareford

*Attorney, Agent, or Firm*—Wood, Herron & Evans, P.L.L.

[57] ABSTRACT

Objects which have been abraded are coated with a coating material which is normally solid at room temperatures. The material is liquified at elevated temperatures and sprayed onto the cooler objects in a heated cabinet, whereupon the material at least partially solidifies on the object. Thereafter, heat is applied to the coating material to cause it to flow out over the coat surface. A cooled conveyor system prevents disruption of the coating material. Overspray is maintained in liquified form within the cabinet where it is reclaimed and flows to a heated sump for direct recirculation to the spray apparatus. There are no deleterious solvent emissions. Apparatus and methods are provided.

61 Claims, 10 Drawing Sheets

APPARATUS AND METHODS FOR APPLYING SOLVENT-FREE LIQUIFIED COATINGS IN A RECLAIM SPACE

This application is a continuation-in-part of U.S. application Ser. No. 07/705,516 filed May 24, 1991, now abandoned, and entitled "Apparatus and Methods for Applying Solvent-Free Liquified Coatings to Object in a Reclaim Space".

This invention relates to coating and more particularly to apparatus and methods for coating objects in a coater cabinet with a protective or decorative coating, which is solid at room temperature.

Elongated objects in particular, such as pipes, have been passed through continuous coater cabinets in which liquid solvent-borne paints or such have been sprayed onto the pipes. In applicant's own prior continuous coater, a hot airless spray system is connected to a spray cabinet through which a product is conveyed. Spray nozzles inside the cabinet are positioned to uniformly cover the product as it passes through the coater. The nozzles may be mounted on automatic reciprocating or rotary machines to provide even greater control. Oversprayed material not deposited on the product is recovered in the cabinet, and after the viscosity of the recovered overspray is tested and make-up solvent is added as required to obtain the desired viscosity in the coating material, it is returned to be resprayed. Products painted in such prior continuous coaters include continuous flexible webs of metal, fabric or plastic, long pieces of metal or wood such as pipe, bar joists, angles, I-beams, moldings, metal lathe and structural siding; roof, floor and wall panels; and a wide variety of small cast, forged or stamped automotive products such as shock absorbers, electric motors, valve covers, rocker arm panels, radiators and many more.

A wide range of coating materials have been used; primarily those which dry by evaporation and/or oxidation and redissolve in their own solvents. These include acrylics (clear and pigmented), alkyds, (clear and pigmented), asphaltums, oil base paints, oleoresinous varnishes, and pipe varnishes.

While such prior systems have worked well, they present several inherent objectionable characteristics. For example, the solvent borne coatings produce solvent vapors upon spraying and curing. These solvent emissions can be deleterious to the environment and must be treated according to various environmental regulations, This can be costly.

Also, the required curing time and the like can unduly extend the coating process and ultimate production yield.

In addition, in order to respray recovered overspray, solvent must be added to make up for the solvent lost during the spraying operation which complicates the system.

Further, the prior coating of pipes with so-called "yard varnish" is somewhat short lived. Such coated pipe has rusted all too quickly when stored, causing downgrading and value reduction resulting in lower pricing and manufacturer's losses.

Still further, when coating smooth objects and articles, such as pipes and the like, it is often difficult to achieve suitable surface adherence of the spray coating to the object to present a smooth, blemish-free coating.

First, the surface of the object may be covered with dirt such that the coating has trouble adhering to the surface, Additionally, the dirt may mix in with the coating leaving gaps therein which affect the performance of the coating and which generally yield a coating with numerous blemishes thereon. Secondly, the surface of the object to be coated may be too smooth, thus preventing good mechanical attachment of the coating material to the object.

An additional problem to producing a blemish-free smooth coating is presented by the fact that the object must be conveyed through the spraying system. This requires contact with the object by a conveyor system after it has been sprayed. As may be appreciated, the coating may not be completely cured or hardened at the point of contact with the conveyor, and therefore, some of the coating material adheres to parts of the conveyor and a blemish appears on the object. Such marring or blemishes may render the product unacceptable thus reducing throughput and efficiency and increasing the costs of operating the system.

Accordingly, it has been one objective of this invention to provide an improved coating apparatus and methods for eliminating deleterious or undesirable solvent emissions from the coating operation.

Another object has been to provide an improved coating apparatus and methods which applies a superior quality coating with improved production efficiency.

Still another object is to provide an improved coating apparatus and methods which permits the direct return of recovered overspray to the spray apparatus without the intermediate step of reconstituting the material in some fashion such as by adding make up solvent.

A further objective has been to provide an improved coating apparatus and methods for coating objects of many types.

A still further objective is to provide a coating apparatus and method which achieves good adherence and attachment of the coating material to the sprayed object.

Another objective is to provide a coating apparatus and method which is capable of conveying the object through the spray system without marring the newly sprayed surface of scraping or otherwise removing unhardened coating from the object.

To these ends, a preferred embodiment of the invention contemplates the application to objects of a coating which is normally solid at room or ambient temperature. The coating material at least partially solidifies on the coated object quickly and is thereafter heated to flow out the material into a uniform coating.

In one preferred embodiment, an elongated object, such as a pipe, is passed through a coating space where it is sprayed with a solvent-free hot melt type coating material which is solid at room temperatures, but liquid at elevated temperatures. The material at least partially solidifies upon application to the pipe, leaving solid coating material globules or particles on the sprayed surface, since the object is colder than the melting point of the material. As a result, the material on the object is not of uniform thickness, but variable or somewhat bumpy as applied and at least partially solidified.

When the pipe or other object emerges from the coating space, its coated surface is momentarily subjected to an application of heat. This melts the coating material and causes the partially or fully solidified portions to flow out together on the surface of the object, thus uniformly coating it.

The coating space is defined within the heated walls of a coating cabinet. In one embodiment, the walls are generally of double wall construction and a heated fluid is pumped through the walls to maintain the interior surfaces of the walls and floor of the coater cabinet at a temperature above the melting temperature of the coating material. This maintains any coating overspray in liquified form so it can flow down the walls into a heated sump from where it can be directly recirculated for spraying. In another embodiment, a single wall has various aluminum heating blocks mounted thereto to heat the walls of the cabinet.

Since the coating material solidifies at room or ambient temperature, the invention contemplates its liquification by heat throughout the coater system. The make-up material is supplied from bulk melters, which include a heater and pump, and is pumped in liquified form into the heated sump of the coater cabinet through a control valve. According to the invention, this valve is controlled by a capacitance operated liquid level sensor in the sump although other types of level sensors might also be used. When the level falls below a predetermined value, the valve is opened to fill the sump to a predetermined fill level. From there it is pumped through a heated, constant flow, double-acting piston pump and control valves to heated spray nozzles located about the coating space in the cabinet.

In one embodiment where a pipe is being coated, six spray nozzles are mounted on a semicircular structure and are staggered from each other to avoid spray interference. The semicircular structure slides on two parallel guides to move in and out of the cabinet for maintenance and adjustment. In another embodiment, six heated spray nozzles are mounted in two semicircular banks of three nozzles each and are staggered on their crescent-shaped mounting frames to avoid spray fan interference. The mounting frames are pivotable for withdrawal from the hot coating space for maintenance and adjustment. The number of spray nozzles will depend upon the size of the coated product.

In order to maintain the pumped coating material in liquified form, heated hoses are used to connect the sump, pump and nozzles together, as well as to connect the material supply to the sump.

Also in the preferred embodiment of the present invention, the object which has been spray coated is conveyed through the coating system on a plurality of drive rollers which are cooled to a low temperature to prevent adherence of the coating material to the rollers. Preferably, the drive rollers are hollow and a cooled liquid, such as cold water, is pumped therethrough to cool the rollers well below the melting point of the spray coating material. The cooled drive rollers not only prevent coating material from being removed from the object and sticking to the rollers, but they also gather condensation to further improve the blemish-free conveyance of a spray coated object through the system.

In one alternative embodiment, the object which is to be coated in the coating space, is subjected, upstream of the coating space, to a preheat station for slightly preheating the object. Preheating can be used to drive off any moisture on the object prior to coating. Final heating, downstream of the coating space, is still preferred for flowing out the coating material on the object, as this eliminates the expense and time of heating up objects, such as long, heavy pipes, prior to coating.

In another alternative embodiment, the object to be coated is subjected to an abrading step before it is sprayed with coating material in the coating space. A series of rotating wire brushes or abrasive flappers are mounted around the conveyor path before the coating space and rotate to clean or abrade the outer surface of the object. The abrasion removes dirt from the object surface and the abraded surface improves the adherence of the sprayed coating. Preferably at least four brushes are mounted around the object to provide abrasion on all sides, and the brushes are mounted opposing each other to rotate in opposite directions and prevent the object to be sprayed from rotating and being scuffed by the conveying equipment.

Accordingly, the invention provides means by which an object can be protectively or decoratively coated without solvent borne coating materials, and there are no deleterious solvent emissions to treat.

Since the object is passed through the coating cabinet with minimal dwell time, i.e. about two seconds, production is not hampered. The final coating cures quickly, after it is heated to flow it out on the object surface, to form a long-lasting and durable protective or decorative coating. The spray patterns are maintained in non-interfering relation, and any overspray is reclaimed.

The object need not be heated in its entirety, and may be coated while at room temperature. Thus, the system is much more energy efficient even with the heated components than if the objects were required to be preheated. This is particularly true in the case of metal pipes which may be on the order of one-half or more inches thick. The energy required to preheat such pipes would be excessive. Moreover, once the pipe is heated and located, removing the heat from the pipe or other object would require significant time, floor space, and possibly expensive energy-using cooling apparatus which would slow down the process and make it even more energy inefficient.

The invention further yields improved adherence of the coating material on the object and prevents the sprayed coating material from being scuffed or scraped from the object as it is conveyed through the coating system.

BRIEF DESCRIPTION OF THE DRAWINGS

These and other objects and advantages will become readily apparent from the following description of a detailed embodiment, and from the drawings in which.

Figure 1:
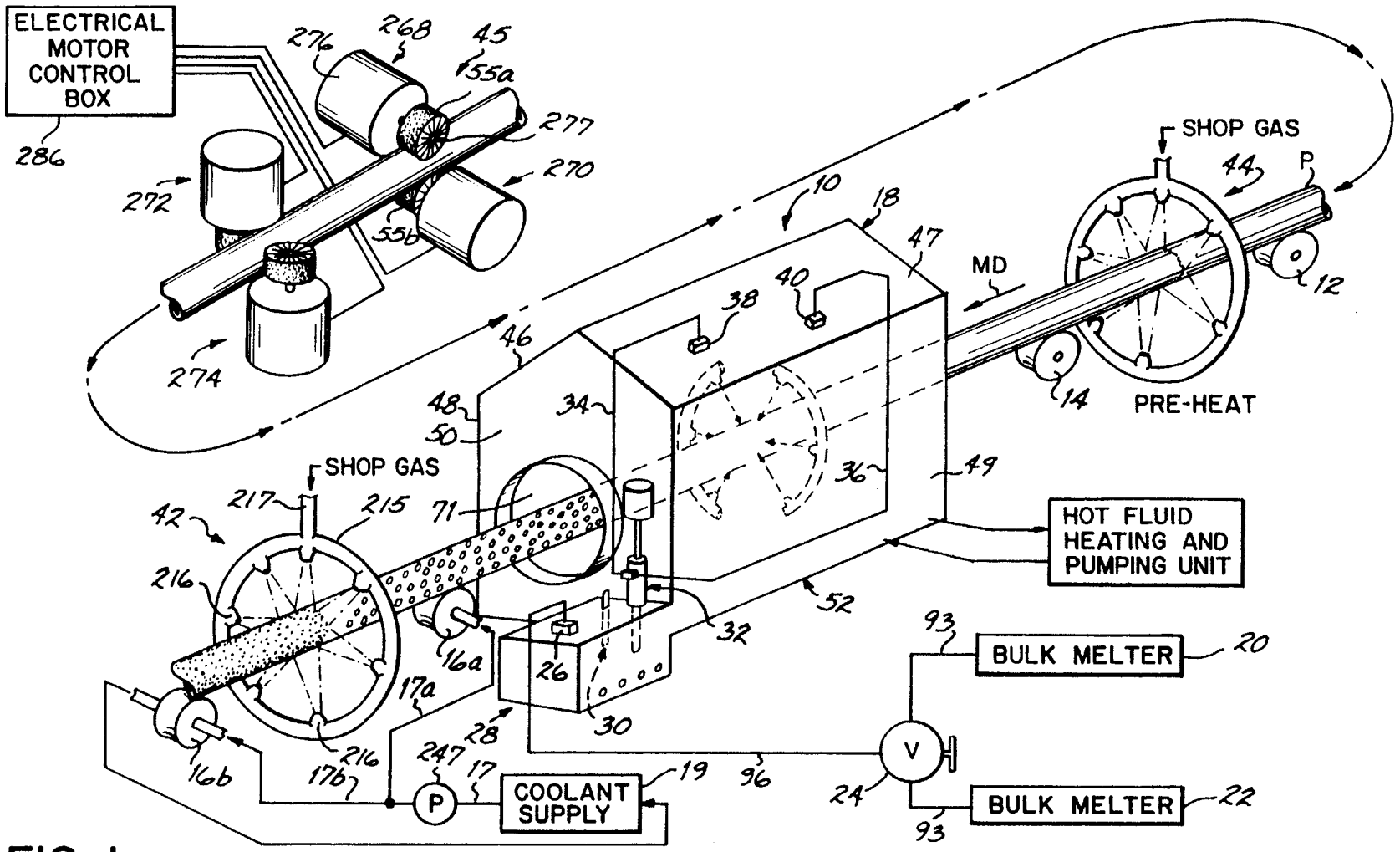
FIG. 1 is a diagrammatic view of a pipe coater according to a preferred embodiment of the invention.

Turning now to the drawings, there is shown in FIG. 1 a continuous coater 10, according to a preferred embodiment of the invention, and also showing an optional pipe preheat station which will be described. The coater 10 is useful for applying protective or decorative coatings to a myriad of various objects of either indeterminate length or discrete and separate in nature. Without limitation, the invention is depicted in the figures for coating elongated pipe, but it could be adapted for use with conduit, coils of steel or other metal, or discrete objects suspended from an overhead conveyor, for example.

OVERALL APPARATUS

The apparatus includes a number of operatively associated components which will be described with reference to the drawings. In general, however, a pipe P is mounted on a series of drive rollers 12, 14 and 16 for conveyance through cabinet 18 in machine direction MD. As discussed in greater detail hereinbelow, the drive rollers 16 which are positioned after continuous coater 10 are cooled to a temperature well below the melting point of the coating material sprayed on pipe P, to prevent adherence of the coating material on the rollers 16. More specifically, the rollers 16 are partially hollowed and are connected by lines 17, 17*a* and 17*b* to a supply of liquid coolant 19 containing a coolant liquid, such as cold water. Cold water is circulated through the rollers 16 to cool the rollers to the desired temperature.

Dual melter supplies 20, 22 of coating material, which is solid at room or ambient temperature, are connected in one embodiment via a switch-over valve 24 to a valve 26 on top of heated sump 28. A level sensor 30 extends into the sump 28 for sensing coating material level and controlling pumps associated with the bulk melters 20, 22 and valve 26 to cause liquified coating material to be pumped into the sump.

A pump 32 is operatively disposed through an inlet (not shown in FIG. 1) in the sump 28 for pumping liquified material therefrom, through heated hoses 34, 36 to valves 38, 40 for controlling the flow of the coating material to spray nozzles within the cabinet.

Once the pipe P is coated, it is passed through a flame heater 42 for melting the coating and causing it to flow out on the pipe surface to produce a uniform coating.

The pipe can also optionally be passed through a preheat flame burner 44 prior to entering cabinet 18. This pre-heats the pipe surface and drives off any moisture to keep it from being trapped under the coating to be applied.

Further, the pipe can also be passed through an abrading machine 45 which includes a plurality of rotating brushes or abrading flaps 55. The rotating brushes 55 clean the outer surface of pipe P and abrade the surface to improve the adherence of the spray coating to the pipe as will be described further hereinbelow.

COATING MATERIAL

The coating material constitutes a solvent-free material which is generally referred to in other applications as hot melt material. One such coating material which is believed to be useful in the invention is manufactured by Chemical Methods, Inc. of Cleveland, OH, under its trade designation, CM-1368 Hot Melt Coating. The material is supplied in 55 gallon drums and is solid at room temperature.

The material is believed to liquify at about 300 degrees F. to about 325 degrees F., but once its temperature lowers below its specific melting point, the material resolidifies. Accordingly, the terms "room" temperature and "ambient" temperature are used herein to refer to that general temperature below which the coating material is in a solidified state.

CABINET

Figure 2:
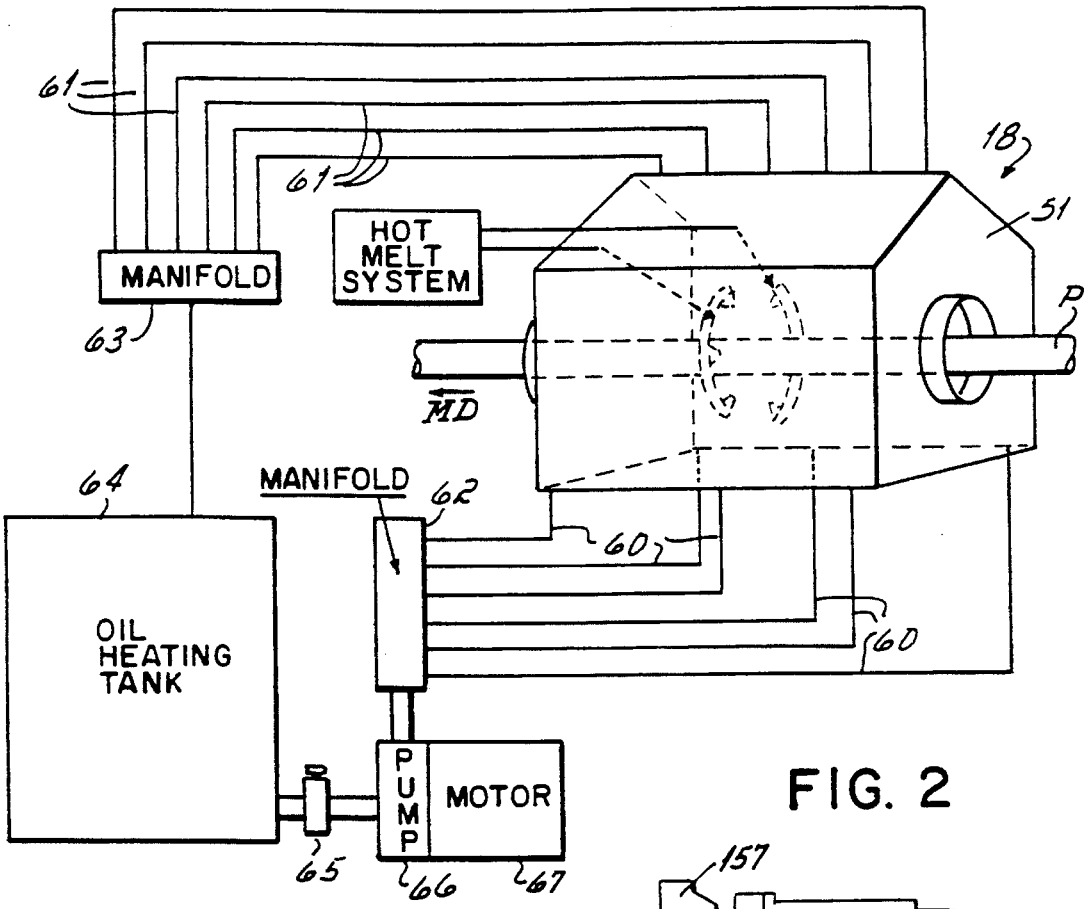
FIG. 2 is a diagrammatic view illustrating further details of the heating apparatus of the cabinet of FIG. 1.
Figure 3:
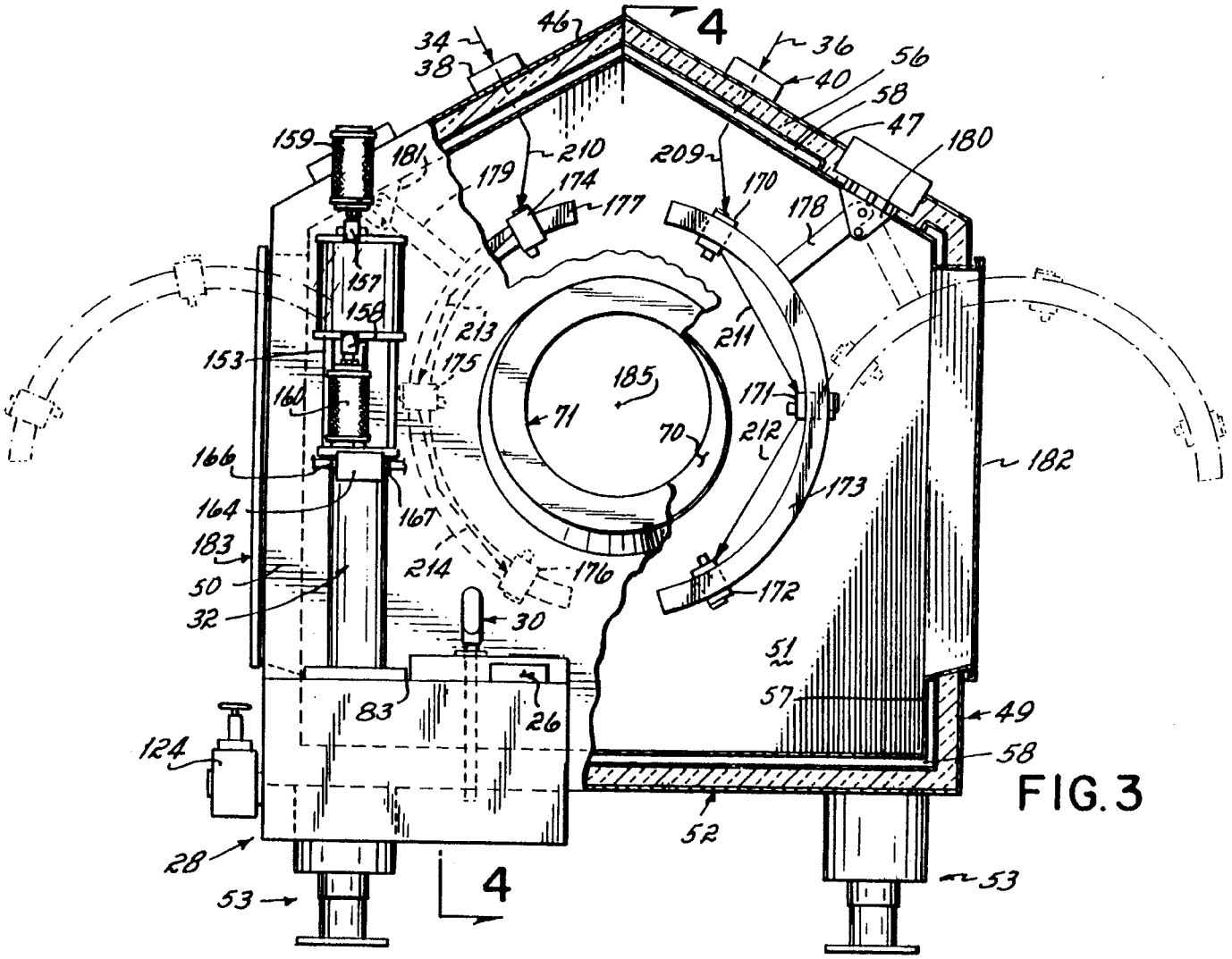
FIG. 3 is an end view in partial cross-section of the outlet end of the cabinet of FIG. 1.
Figure 4:
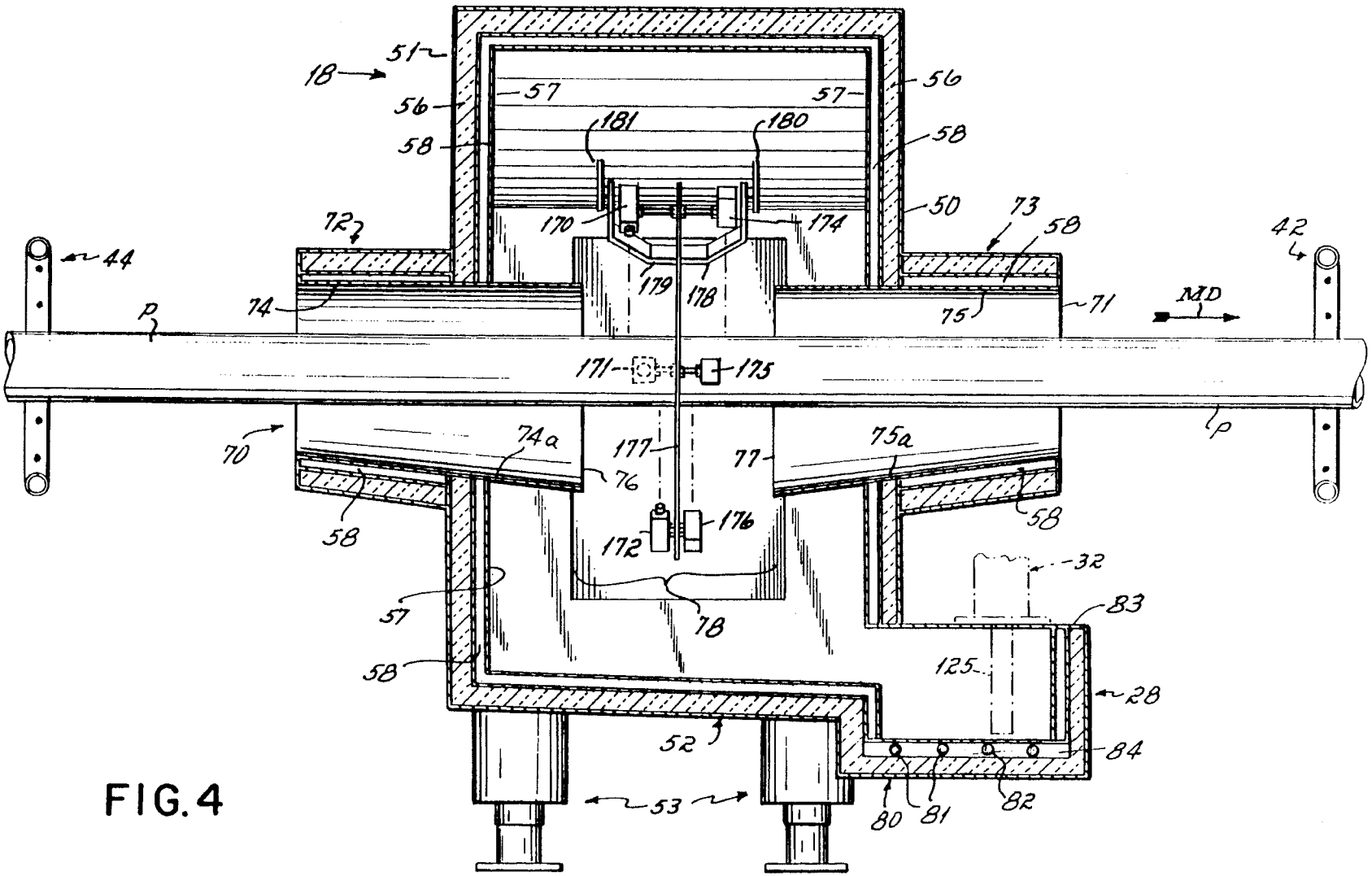
FIG. 4 is a partial cross sectional view taken along lines 4—4 of FIG. 3.

The cabinet 18 of the invention is diagrammatically illustrated in FIGS. 1–4. The cabinet 18 comprises top walls 46, 47, side walls 48 and 49, end walls 50 and 51 (FIG. 2). Cabinet 18 also has a bottom floor 52, which is mounted on adjustable feet 53 of any suitable construction. As best shown in FIG. 4, the floor 52 is pitched or inclined toward the heated sump 28, such that any coating material collecting on the interior surface of the floor 52 tends to flow into the sump 28. It will be appreciated that the sump and various components mounted thereon are shown in FIG. 1 in one position and in the remaining figures in their actual position. The illustration in FIG. 1 is thus modified for purposes of clarity, it being understood that the position of the sump could be varied.

In one embodiment, the walls of cabinet 18 are of a double wall construction, as shown in FIGS. 3 and 4. The outer wall contains insulation, such as at 56, while the inner wall surfaces 57 are spaced from the insulated outer walls 56 to provide fluid circulation spaces 58 between the majority of portions of the outer and inner walls for heating purposes, as will be described.

Turning now to FIG. 2, one possible means for heating the cabinet 18 is shown. The cabinet 18 is provided with a plurality of fittings (not shown) for connecting the cabinet to a plurality of inlet conduits 60, 61 are connected to the cabinet, such that they operatively communicate with the spaces 58 between the inner and outer wall portions 56, 57 of the cabinet. The inlet conduits 60 are connected to an inlet manifold 62, and the outlets conduit 61 are connected to an outlet manifold 63.

In the present preferred embodiment, oil heating tank 64 is connected through a valve 65 to an impeller-type pump 66, driven by an electric motor 67. One suitable pump is pump model number NPE, manufactured by Gould Pump Company of Seneca Falls, N.Y. The heating tank 64 may comprise any suitable tank for heating fluid, such as oil, for example. One suitable heating tank is made by the Chromalox Company of Pittsburgh, Penna., under model designation OTCS, for example.

Pump 66 pumps heated oil from the tank 64 to the inlet manifold 62 and through inlet conduits 60 into the spaces 58 in the double wall structure of the cabinet 18. The heated oil is circulated in the cabinet through the spaces 58 to heat the interior cabinet walls and the space within the cabinet. Once the heated oil has circulated through the spaces 58, it circulates through the outlet conduits 61 to the manifold 63 and back to the heating tank 64 for reheating and recirculation.

The oil is heated to a temperature sufficient to maintain the temperature of the interior surfaces of the cabinet 18 within a temperature range which will maintain any coating material thereon in liquified form. For example, and with respect to he hot melt coating material noted herein, the walls are maintained at a temperature the approximate range of 300 degrees F. to about 425 degrees F. This maintains any oversprayed coating material which is collected on the ceiling, walls, or floor in a liquified state so that it will flow down into sump 28. Other ranges may be approximate for other hot melt coating materials normally solid at room temperatures. Of course, it will be appreciated that the inlet and outlet conduits 60, 61 are interconnected to the cabinet in such a way that all of the spaces 58 are effectively provided with circulating hot oil.

Figures 3A, 3B:
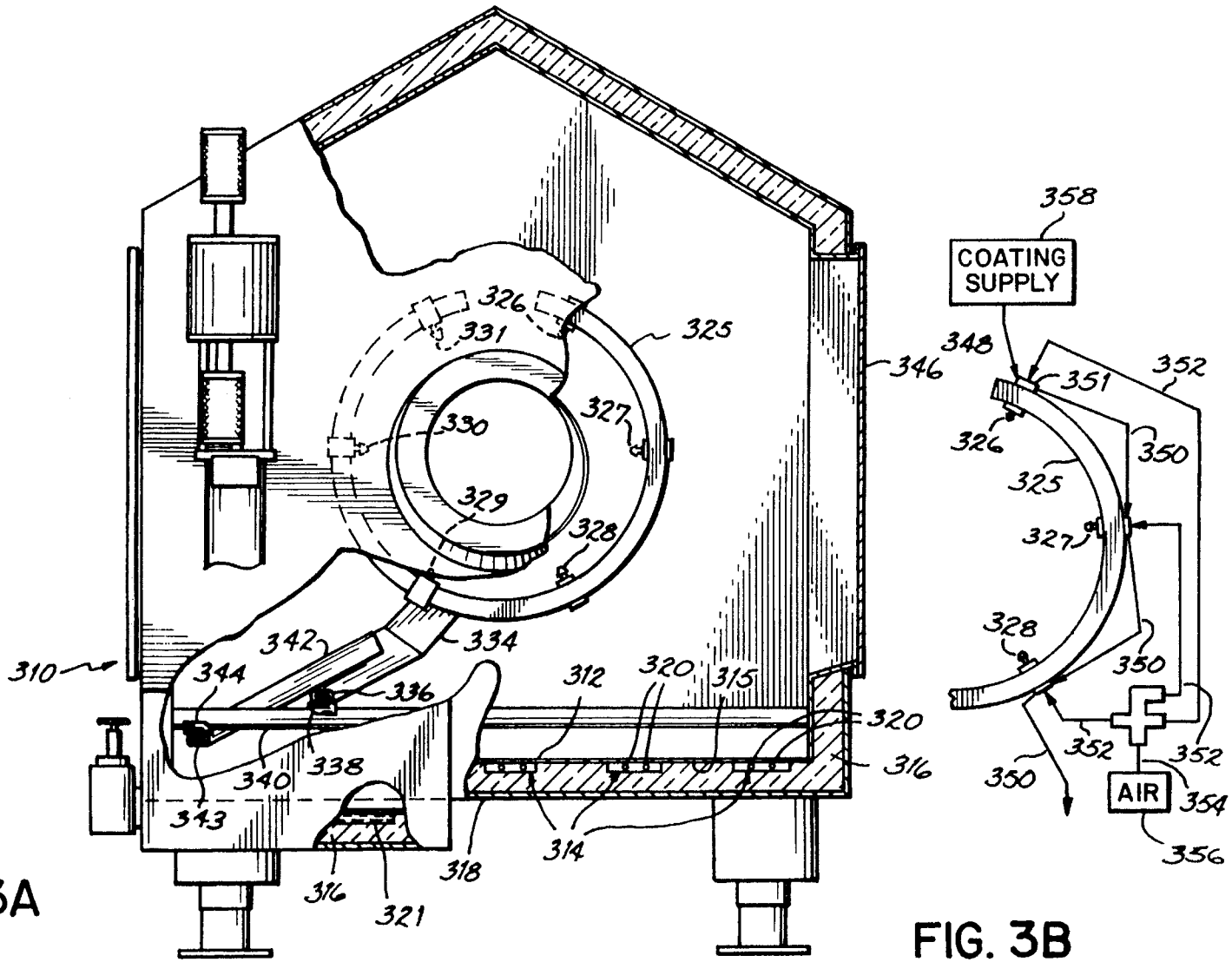
FIG. 3A is an end view in partial cross-section of the outlet end of an alternative embodiment of the cabinet of FIG. 1.
FIG. 3B is a detailed view of the spray device of FIG. 3A with appropriate connections.

An alternative heating means for the cabinet utilizes a plurality of individual heating blocks placed on the inner walls at various positions around the cabinet. Referring to FIG. 3A, the cabinet 310 does not utilize spaces 58 for hot oil circulation as shown in FIG. 3. Instead, an inner wall 312 has various elongated block structures 314, preferably aluminum blocks, attached thereto in intimate surface-to-surface contact with outer surface 315 of inner wall 312. A layer of insulation material 316 exists between wall 312 and an outer wall 318 as previously discussed. The blocks 314 contain elongated resistance heaters 320 which are cast in the blocks 314 and which operate to heat the blocks 314 and thereby heat the cabinet wall 312. The entire cabinet 310 is heated in this way so that the sprayed coating material is maintained in liquified form. The resistance heaters may be of a commercially available type which are generally known and used in other non-related applications and may be regulated by suitable controls (not shown).

Returning to FIG. 4, end wall 51 is provided with an inlet opening 70, while the end wall 52 is provided with an outlet opening 71. Inlet 70 is defined by collar or boss 72, projecting outwardly from the cabinet 18. The outlet 71 is also provided with an outwardly projecting collar or boss 73. Projection 72 includes an inward wall 74, generally cylindrical in configuration, with the exception that the bottom portion 74*a* has a pitch in a downward direction from the outside end of the projection 72, toward the inside of the cabinet 18. The projection 73 includes an interior wall 75, also of generally cylindrical configuration, with the exception that the lower portion 75*a* thereof is pitched from a higher position at the outlet 71 to a lower position inside the cabinet 18. Any oversprayed coating material falling onto these lower pitched surfaces will thus flow down the lower portions of these pitched walls onto the bottom cabinet floor 52.

Interior wall 74 has an inward terminus or opening 76, while the interior wall 75 has an inward terminus or opening 77. Both the openings 76 and 77 are disposed within the cabinet 18 and partially define between them, a coating space 78, as shown diagrammatically in FIG. 4, within the cabinet 18. It will be appreciated that the pipe P emerges from the area surrounded by wall 74 at the opening 76 and is open to the interior of the cabinet, until it proceeds into the opening 77 of the interior wall 75, so that the pipe is exposed to the coating space 78 within the cabinet 18.

THE SUMP

Sump 28 is disposed in this embodiment as shown in FIGS. 1, 3 and 4 for receiving liquified coating material from the cabinet walls and floor, and for receiving liquified coating material from the make-up supply comprising the bulk melter supplies 20, 22. As shown in FIG. 4, the sump comprises a bottom 80, which is disposed below inclined cabinet floor 52 for receiving liquified overspray run off therefrom. The sump has a heated platen 84 in the bottom having a plurality of cartridge heaters 81 therein. A temperature sensor or thermocouple 82 may also be located in the sump bottom 80 for the purpose of sensing and controlling the temperature thereof. The cartridge heaters are maintained by any suitable controls, which do not themselves comprise part of the invention, for maintaining the coating material in the sump in a liquified state. A top sump wall 83 provides a surface to which is secured valve 26, pump 32 and level sensor 30. An alternative embodiment heats the sump with block heaters 321 like those shown in FIG. 3A and discussed hereinabove. The block heaters 321 are situated on the sump 28 in place of platen 84.

BULK MELTERS

Two bulk melters 20 and 22 are diagrammatically shown in FIG. 1. These bulk melters are shown connected to a sump inlet valve 26 via a switch-over means or valve 24. The switch-over means or valve 24 simply connects one or the other of the bulk melters to the valve 26, such that a continuous supply of coating material can be introduced to the sump through the valve 26 from one of the bulk melters while the other is being replaced or refilled. Any suitable switch-over valve can be used.

Alternatively, in one presently preferred embodiment, only one bulk melter is used, and coating material is supplied to the spray nozzles from the sump while a new coating material drum is being loaded into the bulk melter.

Figure 5:
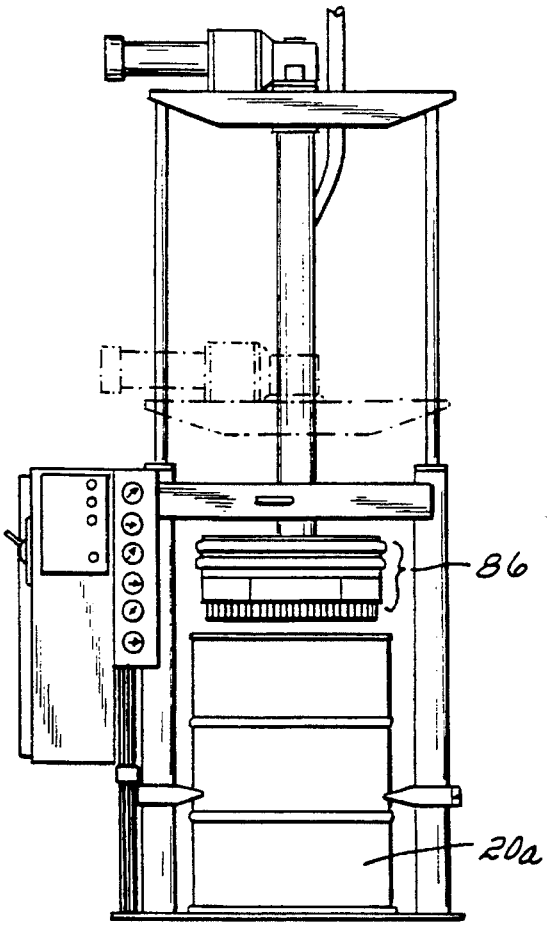
FIG. 5 is an illustrative view of a single bulk melter.
Figure 6:
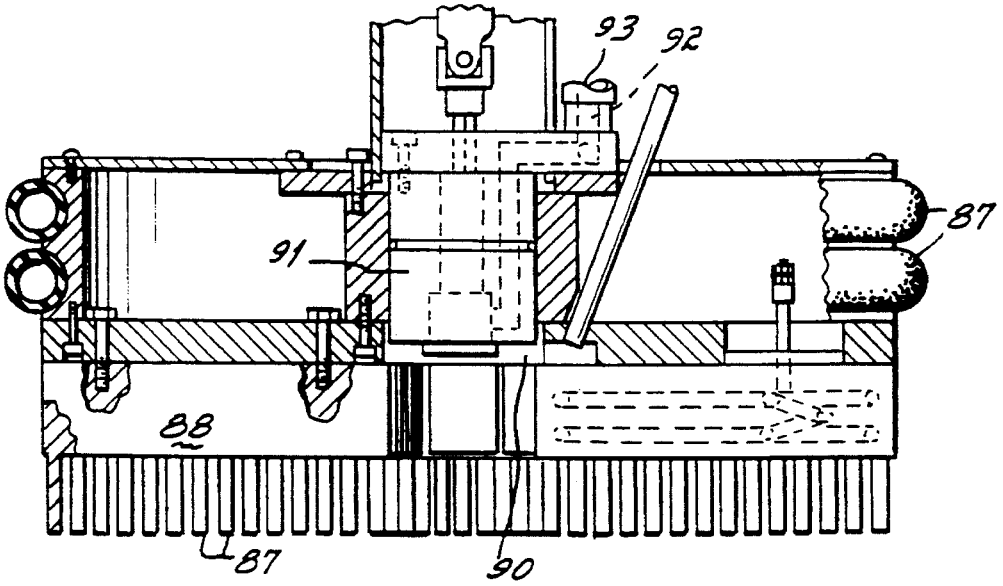
FIG. 6 is a detailed view of selected features of the bulk melter of FIG. 5.

The details of the bulk melters are best shown in FIGS. 5 and 6. Such bulk melters are particularly described in U.S. Pat. Nos. 4,073,409, 4,227,069, and 4,240,567, all of which are expressly herewith incorporated herein by reference. In the present preferred embodiment, a Model 5500 Bulk Melter, manufactured by Nordson Corporation of Amherst, OH, is utilized.

In FIG. 5, herein, a coating material drum 20*a*, which is typically a 55 gallon drum, is disposed as shown beneath a heated platen 86 which is provided with upper circumferential seals 87. A heated member 88 is provided with a plurality of projections 89 for engaging and melting the top layers of the solid coating material within the drum 20*a*. When the heater is activated, it melts the coating material and the thus liquified material flows upwardly, under the weight of the descending platen (which is vertically movable as shown in phantom), into chamber 90, from where it is pumped by a pump 91 through an outlet port 92 to a heated hose 93 for conveyance to the switch-over valve 24.

As suggested in FIG. 5, the platen is movably mounted for vertical motion, such that it can be raised to permit the insertion of a drum 20*a* thereunder, and thereafter can be lowered into the drum in order to melt the hot melt coating material therein, liquify it, and pump it into the heated hose 93 for introduction according to this invention to the sump 28.

The switch-over valve 24 may be of any suitable construction, having two inlets and a single outlet. Each of the inlets are connected to a respective bulk melter 20 or 22 via a heated hose 93 and the outlet connected via a heated hose 96 to the inlet valve 26 of the sump 28.

SUMP VALVE

Any suitable form of control valve 26 may be utilized. One valve which is believed to be particularly suitable is the valve manufactured by Nordson Corporation of Amherst, OH, under its model number H20. Such a valve is described in U.S. Pat. No. 3,570,725, which is expressly herewith incorporated herein by reference. While that patent discloses a nozzle connected to the valve, it will be appreciated that when used in connection with the present invention, the nozzle and retaining nut are discarded and a threaded outlet fitting, such as the threaded outlet fitting 112 of FIG. 8 (later described), is operatively attached to a suitable fitting for mounting the valve on the heated sump 28.

Figure 8:
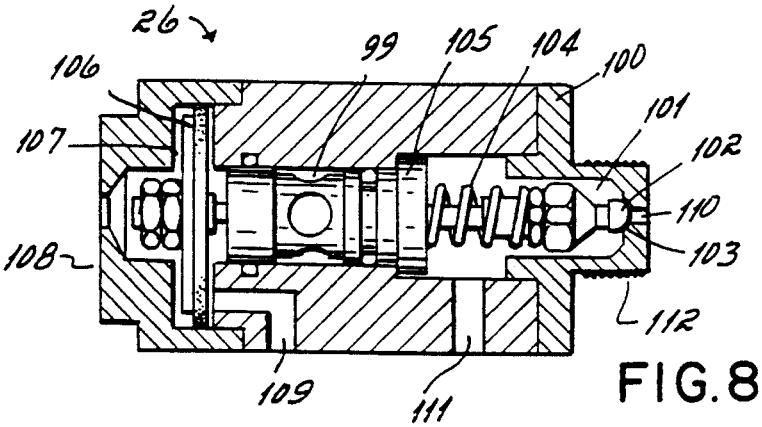
FIG. 8 is a cross-sectional illustration of the sump and nozzle control valves.

Looking at FIG. 8 in detail, the Nordson H20 valve as used in this application, includes a valve block 98 having a passageway 99 therein. A valve plate 100 having a threaded outlet fitting 112, closes off the forward end of the passage 99 and is provided with a chamber 101, receiving a reciprocable valve member 102 and a seat 103. A spring 104 is supported on a flange 105 at its rearward end and at its forward end on the valve member 102 for urging the valve member forwardly into sealing engagement with the seat. At the rear end of the valve block 98, a piston 106 is connected to the valve member 102. Piston 106 resides in a chamber 107, defined by a valve head 108. Accordingly, it will be appreciated that when air under pressure is introduced to the air passage 109 beneath the piston 106, the valve member 102 is pulled rearwardly or to the left, as viewed in FIG. 8, to lift the valve member off of the seat 103 and permit coating material in a liquified state, to move through the valve opening 110 into the heated sump 28. Of course, appropriate fittings (not shown) are provided for connecting the air passage 109 to an appropriate control source of pressurized air, and for connecting the coating material inlet passage way 111 to the heated hose 96, described above.

LEVEL SENSOR

Figure 7:
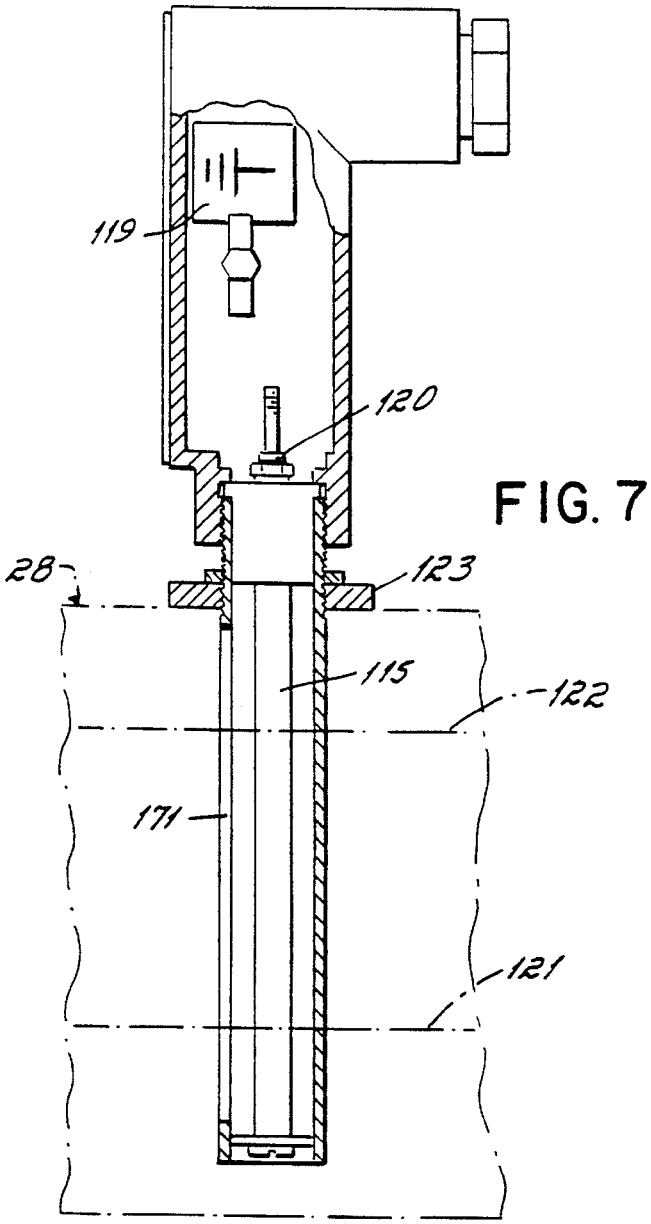
FIG. 7 is a cross-sectional view of the coating material level sensor of the heated sump.

As noted above, a level sensor 30 is associated with the sump for ensuring that the sump remains full enough to provide coating material to be sprayed onto the pipe P. The level sensor 30 is depicted in FIG. 7 and comprises a capacitive level control, having a central rod 115 which forms one plate, and an outer wall 116 which forms another. The wall 116 is generally cylindrical in configuration and is provided with a plurality of slots 117, of about 45 degrees to 60 degrees arcuate section in wall 116 for admitting coating material into the annulus-like space 118 between the rod 115 and the wall 116. The coating material itself serves as a dielectric when disposed within the space 118. The wall 116 is generally connected to a grounded portion of any suitable sensing device 119, while the rod 115 is insulated therefrom and is connected to the sensing device 119 by means of an appropriate terminal 120. Accordingly, the rod 115 and the wall 116, together with the dielectric formed by the coating material therebetween, form a capacitor, the capacitance of which varies according to the level of coating material. This capacitance is then sensed to provide an indication of the level of the material in the sump, and thereby to provide a signal for refilling the sump from the bulk melters 20, 22.

For example, a predetermined low level is illustrated at 121 and a predetermined high level of coating material is illustrated at 122. When the sensing device 89 senses the lower level 121, it provides a signal for the purpose of opening the valve 26 and starting the pumps of the bulk melters 20, 22. Switch-over device 24 is set to select a particular bulk melter, which then pumps liquified coating material through the heated hose 96 and now open valve 26 into the sump to fill it up. Once the level of coating material within the sump reaches the upper predetermined level 122, for example, this is sensed by the sensing device 119, which then signals valve 26 to close and causes the pumps associated with the respective bulk melters 20, 22 to stop. In this fashion, liquified coating make-up material is supplied to the sump when the level falls below a predetermined amount, but does not overflow the sump.

Any suitable sensing device can be used as is well understood. Also, it will be appreciated that the level sensor 30 may be provided with any appropriate fitting such as a flange 123, which can be welded or otherwise connected to the top wall 113 of the sump 28 (FIG. 4).

If desired, a further valve 124 can be provided for simply draining the sump (see FIG. 3).

COATING MATERIAL PUMP

Figure 10:
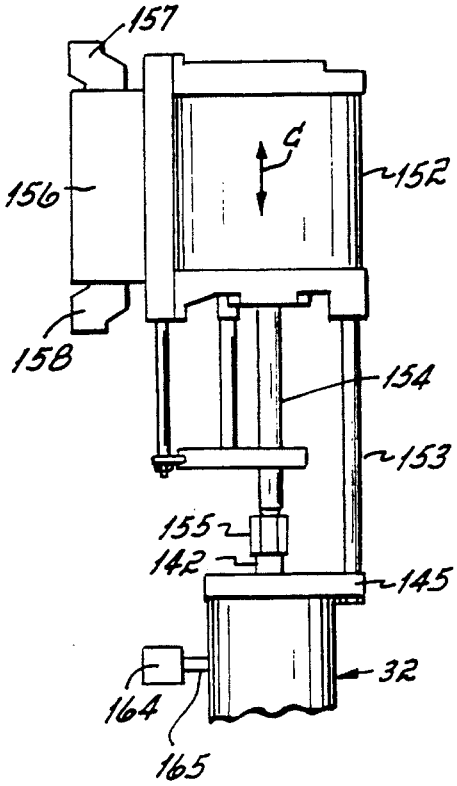
FIG. 10 is a diagrammatic view illustrating the pump motor.
Figure 9A:
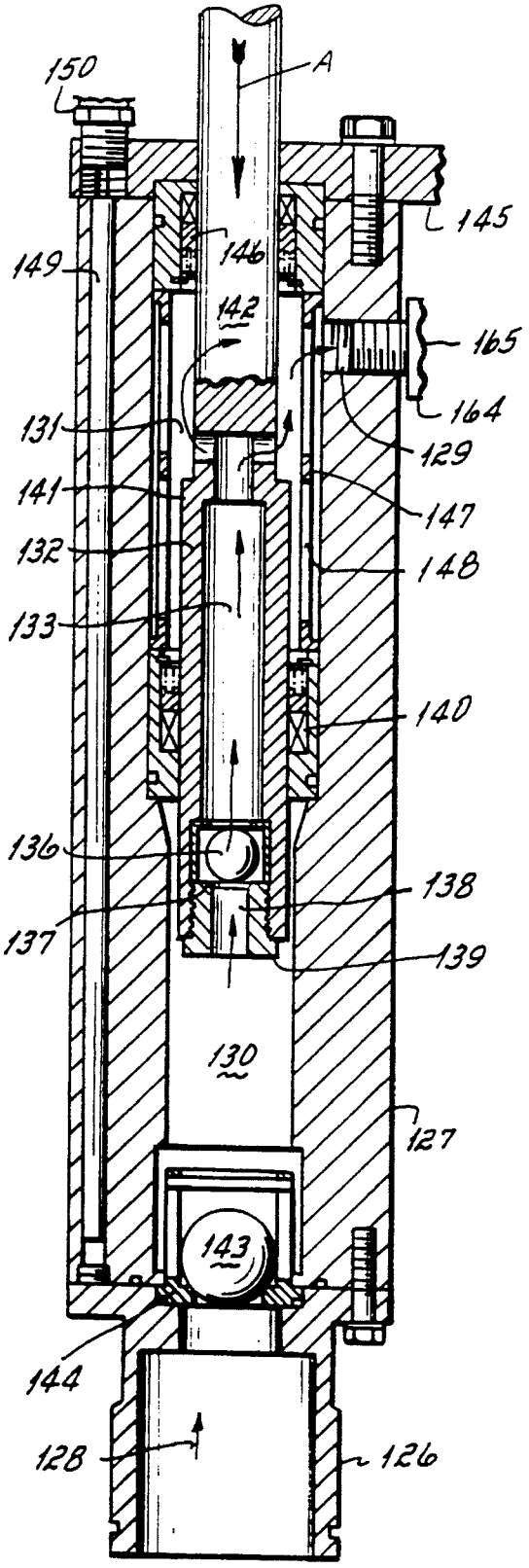
FIGS. 9A and 9B are cross-sectional views illustrating the coating material pump.
Figure 9B:
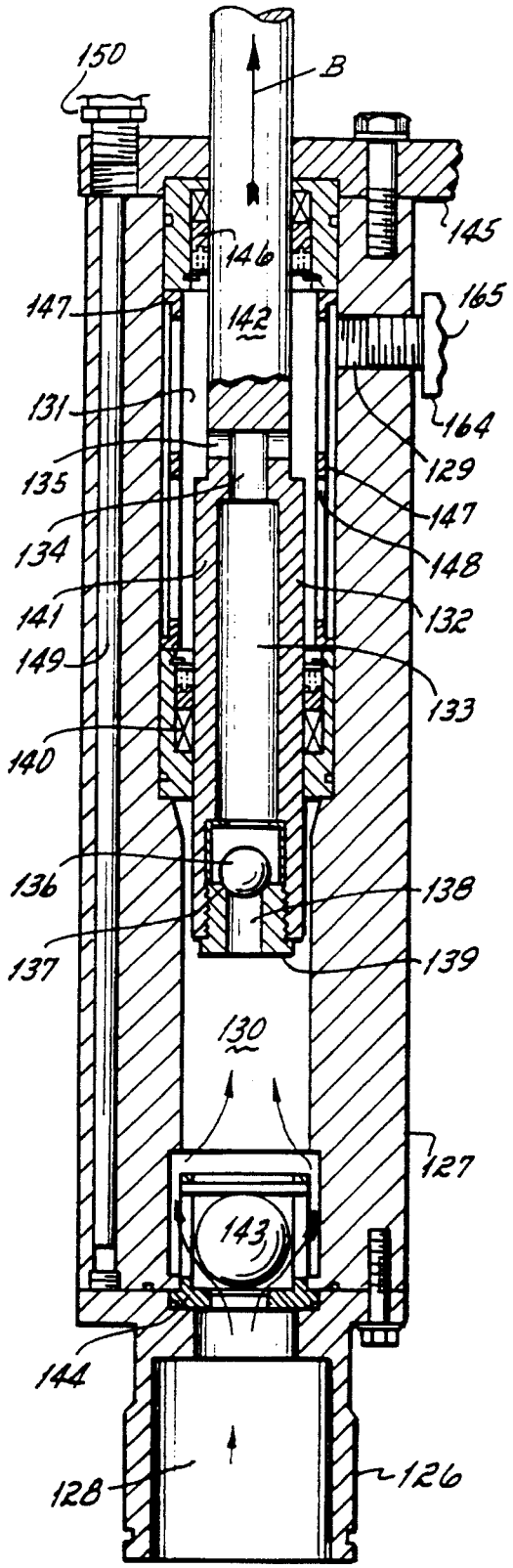

The coating material pump 32 is disposed above the heated sump 28 at the end of the cabinet, as illustrated in FIGS. 3 and 4 (and as shown out of position in FIG. 1 for clarity). The details of the pump 32 are seen in FIGS. 9A, 9B and 10. The pump 32 has a depending intake tube 125 (FIG. 4) extending down into the heated sump 28 for withdrawing liquified coating material from the sump and pumping it for spraying onto the pipe P. The pump 32 as shown in FIGS. 3 and 4, is mounted so that its lower or inlet end is disposed on the top wall 83 of the sump, such that tube 125 can extend downwardly therein. Tube 125 is now shown in FIGS. 9A and 9B, but it will be appreciated that it is connected to the fitting 126, extending downwardly from the pump body 127 (FIGS. 9A and 9B).

The pump 32 is a double acting piston pump, as will be described, having an inlet 128 and an outlet 129, through which liquified coating material from the sump is continuously pumped during motion of the pumping piston in both directions. In this regard, it will be noted that the pump body 127 includes two pumping chambers, 130 and 131. The pump is provided with pumping piston 132, which itself defines a chamber 133 and outlet passages 134 and 135. Piston 132 is also provided with a check valve 136, having a seat 137. In FIG. 9*a*, the valve 136 is off the seat 137, while in FIG. 9B, the valve 136 is in sealing engagement with the seat 137. An intake passageway 138 is defined by a plug 139, which also defines the seat 137 and is disposed in the end of the piston 132, as shown.

The pump body 127 is also provided with a sealing means or packing 140, slidably engaging the piston 132 in sealing relationship on the outer surface thereof, so that the piston 132 can be reciprocated in the various directions indicated by the arrows A and B.

As shown in FIGS. 9A and 9B, the piston 132 has an enlarged outer circumferential section 141 and a narrower circumferential stepped down section 142, extending therefrom. It will also be appreciated that the chamber 130 is smaller in cross-sectional area than is the chamber 131.

At the lower end of the pump body 127, a further check valve 143 is disposed in operative relationship with seat 144.

At the other end of the pump body 127, an end flange is secured to the body and also serves to secure a packing or seal 146, engaging the outer circumferential surface of the stepped down piston portion 142. This end of the piston 142 extends outwardly of the flange 145 for engagement by an air motor (FIG. 10), as will be described.

It will be appreciated that a sleeve 147 is mounted within the chamber 131 and is provided with a plurality of slots 148. This sleeve functions to maintain the sealing member 140 in the pump body as shown.

The pump body 127 is also provided with a chamber or a bore 149 for receiving a cartridge or resistance rod heater for heating the pump body and maintaining any coating material therein in liquified form. The cartridge heater is maintained in the bore 149 by means of the fitting 150, which accommodates any appropriate electrical circuitry to the cartridge.

Referring now briefly to FIG. 10, it will be appreciated that the pump 32 is operatively interconnected to an air motor 152, as shown in FIG. 10, by means of one or more struts 153. The air motor has an extensible shaft 154, which is connected by the coupling 155 to the piston portion 152 of the pump 32. As the air motor is operated, it reciprocates the drive shaft 154 in the direction of the arrow C, as shown in FIG. 10. This consequently reciprocates the piston 132 in the opposite directions of arrows A and B as shown in FIGS. 9A and 9B.

The air motor 152 is provided with an exhaust manifold 156 interconnected through respective fittings 157 and 158 to exhaust mufflers 159 and 160 (FIG. 3). The air motor is a double acting air motor, as described, and appropriate controls are provided for energizing the air motor to reciprocate the shaft 154 and thereby the piston 132 of the pump 32.

Of course, any suitable heated pump can be utilized, however, the pump described above has been found useful and generally constitutes a pump manufactured by Nordson Corporation under its model number 5520.

Returning now to FIGS. 9A and 9B, the operation of the pump will now be described. In FIG. 9A, the piston 132 is shown near its fully extended position, but has started to move in the direction of arrow A, or toward the inlet 126. In this condition, it will be appreciated that the chamber 130 has already been filled with liquified coating material by a previous stroke. As the piston moves toward valve 143, it displaces material in the chamber 130. This pressurizes the valve 143 into sealing engagement with the seat 144, so that coating material in chamber 130 cannot be exhausted through the inlet 128. Instead, the material is exhausted through the seat 137, since the ball 136 is moved therefrom, and the material enters into chamber 133 and moves through passageways 134 and 135 into chamber 131. The pressure differential generated by the displacement of more volumetric area in chamber 130 than in chamber 131 causes liquified coating material in the chambers to be exhausted toward the outlet 129.

Once the piston has traveled to its position nearest the valve 153, the air motor is reversed to reverse the piston 132 and move it in the direction of arrow B in FIG. 9B. During this motion, the chamber 130 is filled with liquified coating material from the inlet 128, while at the same time the enlarged piston portion 141 is moved into the chamber 131, thereby reducing the available volume in the chamber 131, pumping liquified coating material therein through the outlet 129. This is assured by virtue of the fact that when the piston 132 moved in this direction, the valve 136 seats on seat 137 in sealing engagement so that material in the chamber 131 and any coating material in the chamber 133 cannot exhaust back into the chamber 130. At the same time, since the piston 132 is moving out of chamber 130, the pressure differential thereby created unseats the valve 143 from the seat 144 and sucks liquified coating material from sump 28 through the inlet 128 into the chamber 130.

It will thus be appreciated that the greater cross-sectional area portion 141 of piston 132, when moving in the direction of arrow B, serves to exhaust larger cross-sectional chamber 131 through the outlet 129, while the pressure created by that same portion 141 of piston 132, when moving in a direction of arrow A, serves to pressurize smaller cross-sectional chamber 130 and thus continues to exert pressure in chamber 131 to exhaust liquified coating material when the piston moves in the direction of arrow A.

This reciprocal motion of the piston 132 continues, thus pumping liquified coating material through the outlet 129, for both motions of the piston in the directions of arrows A and B. Chamber 130, however, is only refilled from the inlet 128 when the piston moves in the direction of arrow B, as shown in FIG. 9B.

The outlet 129 is connected to a fitting 164 (FIG. 3), which has an inlet 165 and two outlets 166 and 167 (FIG. 3). These outlets are connected to heated hoses 34, 36 extended therefrom for conveying the pumped liquified coating material to the banks of nozzles for spraying onto the pipe P.

NOZZLES AND CONTROL VALVES

For one embodiment of the invention, two banks of nozzles for spraying the pipe P are illustrated in FIGS. 3 and 4. Each bank contains three separate nozzles mounted on arcuate or semi-annular support members. Nozzles 170, 171 and 172 are mounted on arcuate support member 173. Nozzles 174, 175 and 176 are mounted on arcuate support member 177.

Each of the arcuate support members 173 and 177 are mounted by respective struts 178 and 179 to pivot fittings 180 and 181 mounted on the cabinet 18. The cabinet 18 is provided with opposed doors 182 and 183 in the sidewalls 49, 48 thereof respectively, and when it is desired to maintain or adjust the respective nozzles or their banks, the arcuate supports 173, 177 can be pivoted as shown in the phantom lines, outwardly of the openings when the doors 182, 183 are opened.

The nozzles are mounted on the arcuate supports 173, 177 in staggered fashion, as illustrated in the drawings. For example, it will be appreciated that nozzles 170–172 are mounted on one side of the support 173, while the nozzles 174–176 are mounted on the opposite side of arcuate support 177, as illustrated in FIGS. 3 and 4. Moreover, the nozzles 172 and 176 are respectively mounted relatively closely to the respective arcuate supports, while the nozzles 171, 175 are mounted a little bit further away from their respective supports, and nozzles 170, 174 are mounted still further away from their respective supports, as shown in FIG. 4. Accordingly, the fan-shaped spray patterns emanating from the nozzles are directed inwardly toward the pipe axis 185, but the fan-shaped spray pattern emanating from each of the respective nozzles do not interfere with each other.

Figure 11:
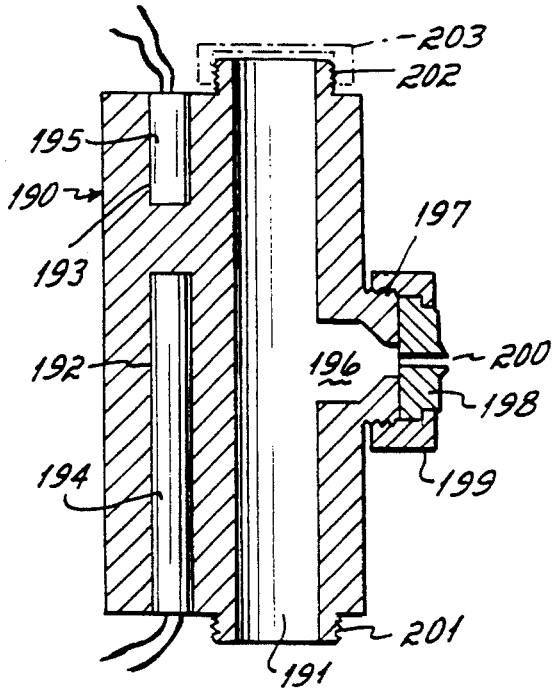
FIG. 11 is a diagrammatic view of one of the heated spray nozzles.

The details of the nozzles are best seen in FIG. 11. Each nozzle includes a nozzle block 190 and coating material bore 191 passing therethrough. The nozzle blocks 190 are also provided with a cartridge heater bore 192, and a thermostat bore 193. A cartridge heater 194 is disposed within the bore 192 and a thermostat 195 for sensing the temperature of the heated nozzle block is disposed in the bore 193. The heater 194 and the thermostat 195 may be of any suitable variety or kind, as shown diagrammatically in the drawings at 194 and 195, respectively.

A transverse passage 196 communicates with material passage 191 to an externally threaded outlet projection 197. A nozzle 198 is secured onto projection 197 by means of a nozzle retaining nut 199. The nozzle 198 has a nozzle outlet 200 for producing a fan-shaped spray pattern for spraying liquified coating material onto the pipe P. In the presently preferred embodiment, nozzles manufactured by Nordson Corporation of Amherst, OH, under Parts Nos. 710,889 and 050,149 have been found to be suitable. These nozzles produce a 20 inch wide fan pattern 10 inches from the nozzle with a flow rate of 0.14 gallons per minute, and six nozzles are arrayed symmetrically around the pipe, as shown in the figures. These nozzles have been used to coat pipe 5½ inches to 13⅜ inches in diameter.

As shown in FIG. 11, at each end of the bore 191 are projections 201,202, for operative connection to a heated hose or to a plug. In this regard, and returning momentarily to FIG. 3, it will be appreciated that the respective nozzles 172, 176 have a plug on one of the projections 201,202, while the other projection of these nozzles is connected to a heated hose for connecting the respective nozzle to the next upstream nozzle. In this regard, it will be appreciated that the supply of liquified coating material to the nozzles is termed "a dead ended supply" and does not recirculate, however, such recirculation could be provided if desired as discussed below with an alternative embodiment.

Each of the nozzles' banks are connected to the pump 32 via the respective heated hoses and valves, as will now be described. The outlets 166 and 167 from the pump fitting 164 are connected via heated hoses 34 and 36 to filters (not shown), and then to control valves 38, 40 respectively. Each of these control valves comprises a valve like that valve 26 as shown in FIG. 8, Such valves can be any suitable valves but, as shown, are air-operated valves for passing liquified coating material from the inlet passages 111 outwardly of the valves into heated hoses 209 and 210 respectively, to nozzles 170 and 174, A heated hose 211 is interconnected between nozzle 170 and 171, while heated hose 212 is connected between nozzles 171 and 172, thereby conveying liquified coating material from the valve 40 to the nozzles 170, 171 and 172. Respective hose 213 is connected between nozzles 174 and 175 while hose 214 is interconnected between valves 175 and 176. Thus, liquified coating material is passed from valve 38 through heated hose 210 to nozzle 174 and then through the respective hoses 213 and 214 to nozzles 175 and 176.

Thus, when it is desired to spray a pipe P, an appropriate signal is generated to energize the air motor 152 to operate pump 32 and the valves 38 and 40 are opened. The pump thus pumps liquified coating material through the fitting 164 and outlets 166 and 167 into the heated hoses 34 and 36, respectively. The valves 38 and 40 are energized to their open position to permit liquified coating material to flow through heated hoses 209 and 210 into the respective banks of nozzles as described.

In an alternative embodiment of the invention, a single semicircular structure is utilized for securing the nozzles. More specifically, FIG. 3A shows a semicircular structure 325 which is shown supporting six nozzle 326, 327, 328, 329, 330 and 331; a greater number of nozzles may be utilized depending upon the size of the coated pipe. As with the previous embodiment, the nozzles are staggered so that individual fan-shaped spray patterns do not interfere with each other. For example, nozzles 326, 327 and 328 are mounted on one side of structure 325, while nozzles 329, 330 and 331 are mounted on the other side. Furthermore, nozzles 326, 331 are mounted a distance from structure 325 and nozzles 327, 330 are mounted a greater distance from the structure 325 while nozzles 328, 329 are mounted a still greater distance from the structure.

The structure is mounted to a support arm 334 which, in turn, is connected to a horizontal rectangular tube 336 which is coupled through an angle 338 to the top of an elongated cylindrical guide 340 located on one side of cabinet 310. A similar angle and a parallel guide (not shown) support the tube 336 at its other end proximate the other side of the cabinet 310. An extension 342 is fixed to arm 334 and connects to a tube 343 and an opposing angle 344 which rests against the bottom of guide 340. As with angle 338, a similar angle (not shown) to angle 344 rest against the bottom of a guide (not shown) on the other side of cabinet 310 which extends parallel to the guide 340. The sets of angles, such as angles 338 and 344 hold the arm 334 and structure 325 in position and couple the arm 334 to the parallel guides which extend from side-to-side in cabinet 310.

Referring to FIG. 3A, the weight of structure 325 forces angle 338 against the top of guide 340 and levers the other angle 344 up against the bottom of guide 340. To move the structure 325, that is, to slide structure 325 sideways in cabinet 310 for maintenance or repairs, structure 325 is lifted slightly to remove the pressure exerted on guide 340 by angles 338, 344. The structure may then be slid across the parallel guides and out a door 346 in the side of cabinet 310.

The nozzles 326, 327, 328, 329, 330 and 331 are generally similar and thus descriptions of one nozzle 326 sufficiently describes them all. As shown in FIG. 3B, the nozzles are continuous circulation airless nozzles which do not utilize heated nozzle blocks as discussed in a previous embodiment. A supply hose 348 connects into one side of nozzle 326 while another hose 350 connects to the other side of nozzle 326. The hoses 348, 350 are coupled to a supply of spray material 358 and an appropriate pumping system, as discussed above, to spray material on a pipe or other object. The hoses 348, 350 are preferably heated to maintain the material in a liquified state, and heated coating material is continuously circulated through the nozzle body 351. Nozzle 326 is activated by an air hose 352 which is operable to turn the nozzle on and off with pressurized air from an appropriate pressure system 356 coupled to hose 352. As is shown in FIG. 3B, each of nozzles 326, 327 and 328 are coupled together with supply hoses, such as hose 350, while each nozzle is coupled to an air supply hose 354 through air hoses such as hose 352. Similarly, nozzles 329, 330 and 331 are coupled together with appropriate supply and air hoses. Nozzles suitable for the embodiment of the invention disclosed in FIG. 3A are manufactured by Nordson Corporation of Amherst, Ohio, under Parts Nos. 710, 889; 050, 149; and 050, 139, although other airless spray nozzles may be suitable.

COOLED CONVEYOR SYSTEM

Figure 12:
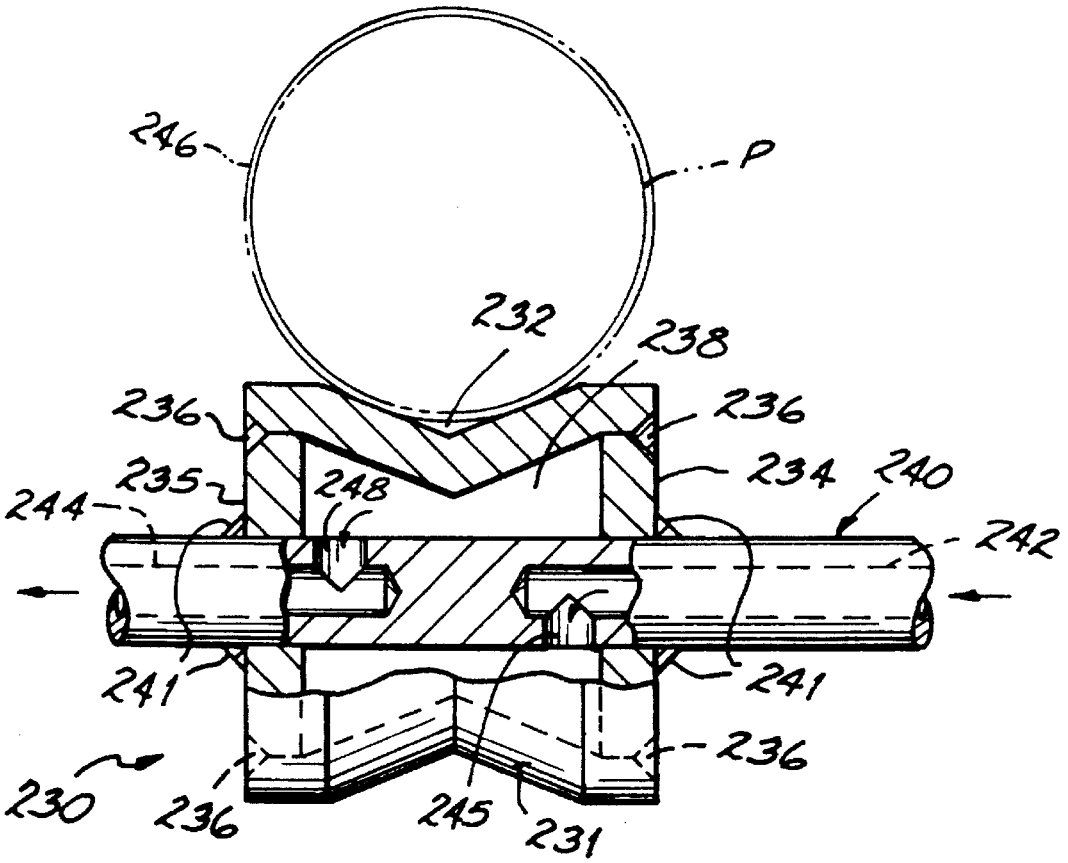
FIG. 12 is a cross-sectional view illustrating the cooled conveyor rollers.

As shown in FIG. 1, rollers 16 are connected to a coolant supply 19 by line 17 which branches into individual lines a, 17*b* for rollers 16*a* and 16*b*, respectively. The coolant supply 19 pumps a coolant, such as cold water, through rollers 16*a*, 16*b* to cool the rollers and prevent adherence of the sprayed coating thereon. More specifically, FIG. 12 illustrates a roller 230 similar to drive rollers 16*a*, 16*b* of FIG. 1. Roller 230 preferably has an hour-glass shape and an outer surface 231 which is angled on opposite sides to define a groove 232 which supports and contains pipe P as shown. The surface sides are preferably angled 45° or less from the horizontal. Roller 230 is hollow and is sealed at both ends by end plugs 234, 235 which are welded to the roller 230, such as by water tight welds 236. The roller 230 and end plugs 234, 235 define a coolant space 238 within roller 230 for receiving the cold water. As will be appreciated while water if preferred, other coolants might also be utilized as appropriate.

Roller 230 rotates on an axle 240 which extends through openings in the end plugs 234, 235. Another fluid tight weld 241 seals the interface between end plugs 234, 235 and axle 240. The axle 240 is coupled at both ends to rotary seals (not shown) so that roller 230 and axle 240 may rotate. Therefore, coolant space 238 is preferably completely fluid tight. An elongated input bore 242 is formed within axle 240 and is connected via line 17 to the coolant supply 19. An output bore 244 is also formed in axle 240 generally co-axially with the input bore 242. Output bore 240 is connected via line 17 to drain into the coolant supply 19. The input and output bores 242, 244 include perpendicular extensions 245, 248, respectively, which open into the coolant space 238 of roller 230, such that cold water may be input into coolant space 238 through bore 242 and then drained through bore 244. The continual circulation of coolant ensures that roller 230 is maintained at a predetermined temperature well below the melting point of a layer of coating material 246 on pipe P. Preferably, roller 230 is maintained at approximately 45° F. Coolant supply 19 includes a conventional pumping device 247 (See FIG. 1) which continually circulates coolant through roller 230.

After pipe P has been coated with a layer of coating material 246, it is seated within groove 232 of roller 230 and is directed to an end position somewhere further down the line in the machine direction MD as shown in FIG. 1. Preferably, the roller is formed of a conductive metal such as carbon steel which may be rapidly cooled by circulating coolant so as to maintain the outer surface 231 of roller 230 at the desired temperature. The cooled surface 231 prevents melting of the layer of coating material 246 and further cools and hardens layer 246. Since it is cooled well below the melting point of the coating material. This prevents adhesion of coating material to the surface 231 and thereby produces a smooth, non-blemished coat on pipe P.

Furthermore, roller 230 is preferably cooled to around 45° F., which is generally below ambient temperature. Therefore, condensation forms on surface 231 of roll 230 and further enhances the operation of roller 230 by preventing adhesion of the coating material layer 246 onto surface 231. The coated pipe P is thus conveyed from the cabinet to the endmost position of the processing line with smooth layer 246 of coating material remaining intact thereon. As may be appreciated, a plurality of rollers similar to roller 230 might be utilized along the conveyor line after coater 10 in order to ensure that the layer 246 has sufficiently hardened and will not adhere to a roller surface. The respective axles, such as axle 240, of the cooled rollers are supported by any suitable support structure, and the input and output bores 242, 244 connected to line 17 by conventional coupling structures as are known in the art.

DOWNSTREAM HEATER

As shown in FIG. 1, a heater means 42 is disposed downstream of the cabinet outlet 71. The heater means 42 comprises, in the presently preferred embodiment, a flame heater having a manifold 215 mounting a plurality of flame burners 216. Flame burners 216 are oriented to open inwardly toward the pipe P for directing flames emanating from the burners toward or onto the pipe P. Manifold 215 is connected to a gas inlet conduit 217, which is connected to a source of flammable fluid, such as natural gas, propane or other available suitable shop gas. The flame heater 42 can be operated then to generate heat directed to the outer surface of the pipe P. Of course, any heating means can be utilized and that heating means shown is only illustrative.

The heat generated by the flame burners 216 is selected so that the heat applied toward the pipe P is sufficient to liquify solidified or partially solidified coating on the pipe. This liquification causes that coating material to flow together to provide a uniform coating on the pipe P or other object being coated which, of course, is moving in the machine direction indicated by the arrow MD in FIGS. 1 and 4, for example.

ABRADING MECHANISM

Figure 13:
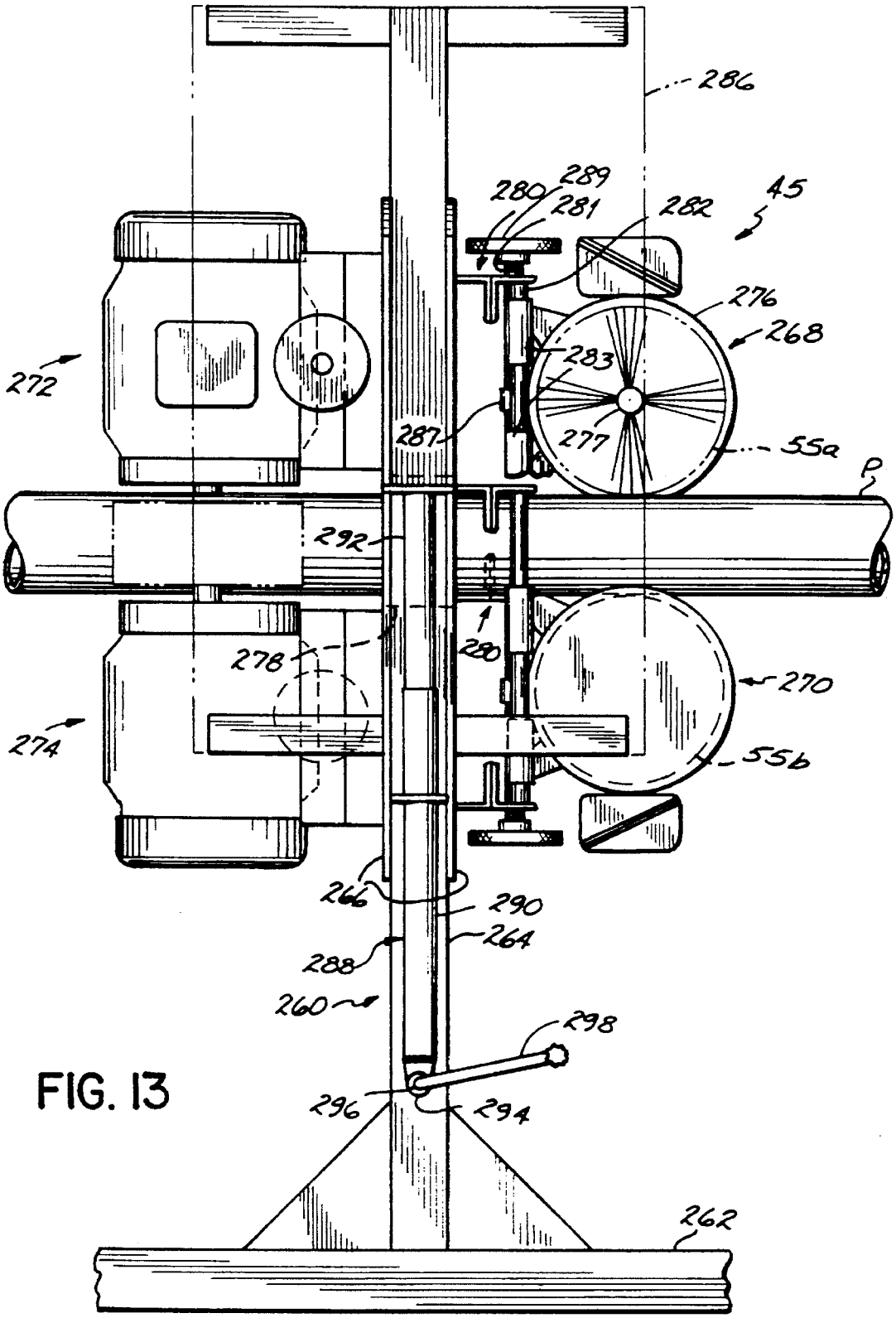
FIG. 13 is a side view of the abrading mechanism.

FIG. 13 illustrates the abrading mechanism 45 which might be inserted upstream of the cabinet 18 of coater 10. The abrading mechanism 45 includes a plurality of rotating brushes or abrading flaps 55 which rotate and brush or abrade pipe P as it passes through the mechanism 45 as will now be described in greater detail.

Abrading mechanism 45 utilizes a mounting frame 260 which includes a base 262 and a vertical stand 264 which supports a mounting plate 266 which is vertically adjustable in height with respect to stand 264. Mounted on opposite sides of mounting plate 266 are upper and lower abrading devices 268 and 270 and left and right abrading devices 272 and 274. Each of the abrading devices 268, 270, 272 and 274 are similar, and therefore, for the purposes of illustrating the invention, only one of the abrading devices will be described in detail.

Upper abrading device 268 includes a motor 276 with a rotating shaft 277 which supports and rotates an abrading brush or an abrasive flapper wheel 55. An abrading brush might be a wire brush, which are generally available in different wire diameters for various applications, Therefore, the brush 55 is preferably removable from shaft 277 so that different brushes might be installed as necessary. An opening 278 is formed in mounting plate 266 so that pipe P may extend through the plate 266. When pipe P extends through opening 278, the rotating brush 55 rotates against the pipe and brushes or descales the pipe to remove dirt and other loose particles from the surface of the pipe. Furthermore, the brush 55 abrades the outer surface of pipe P to produce various random grooves and scuffs (not shown) within the outer surface. The removal of dirt and the abrading of the outer surface of pipe P ensures very good mechanical attachment of the coating material to the pipe P which otherwise might be prevented due to excess dirt or the very smooth surface of the pipe.

Motor 276 is adjustably mounted to guide plate 266 by a bracket 280. Bracket 280 is mounted to plate 266 and includes two parallel guide tracks 282. Guide sleeves 283 are movable on tracks 282. Motor 276 is fixed to guide sleeves 283 to move up and down with respect to plate 266 on tracks 282. To adjust the position of motor 276 and brush 55 with respect to opening 278 in the mounting plate 266 a screw 281 is mounted parallel with tracks 282 and is coupled to a threaded guide 287 which moves up and down screw 281 when the screw is turned such as by hand wheel 289. The guide 287 is rigidly mounted to motor 276 to move the motor along tracks 282 when the hand wheel 289 is turned. In that way, the brushes 55 of abrading mechanism 45 may be adjusted for different size pipes. Similarly, each of the lower and left and right abrading devices 270, 272, and 274, respectively, may be adjusted on mounting plate 266 in order to use with pipes of varying diameters or other elongated objects to be coated according to the principles of the present invention.

Preferably, the brushes 55 of an abrading device pair such as upper and lower abrading devices 268, 270 and left and right abrading devices 272, 274 are controlled to rotate in opposite directions. This ensures that the pipe or other elongated object being abraded does not rotate during the abrasion process. For example upper brush **55*a* might spin clockwise while lower brush 55*b* might spin counter clockwise similarly, left and right brushes would spin in opposite directions. The abrading devices ensure that generally all surfaces of the pipe P are cleaned and/or abraded. Alternatively, further abrading devices might be added and staggered with respect to each other around the diameter of pipe P or the shape of another elongated object in order to ensure that all surfaces of the object are clean. An electrical motor control box 286 may be mounted to vertical stand 264 as shown in phantom in FIG. 13** to house conventional controls for the motors of the individual abrading devices, such as to adjust the speed and rotational direction of the brushes.

Mounting plate 266 is also vertically adjustable with respect to stand 264. Referring again to FIG. 13, opposing cylinder and piston units 288 are positioned on either side of plate 266. Only one cylinder and piston unit is shown in FIG. 13; however, a similar unit is located on the other side of frame 260. Cylinder 290 of each unit houses a movable piston 292, which moves vertically up and down in the length of cylinder 290. The upper ends of pistons 292 are attached to an upper portion of plate 266 to push the plate vertically upward when the cylinder and piston units 288 are actuated. Conversely, the lower ends 294 of the cylinders 290 are coupled to and supported by a shaft 296 which may be rotated by handle 298 to move the pistons 292 within cylinders 290. Shaft 296 extends through openings in stand 264 and is supported thereby in order to support units 288. Shaft 296 is coupled to each of the cylinder and piston units 288 such as by gears or some other coupling device, so that when handle 298 is rotated, the pistons 292 move upwardly to move the mounting plate 266 and abrading wheels 55 upwardly, Mounting plate 266 is coupled to vertical stand 264 such that stand 264 moves vertically. As may be appreciated devices might be utilized to adjust the height of the abrading mechanism 45 in accordance with the principles of the present invention. Therefore, the mechanism 45 may be adjusted to a variety of different heights to be placed in the coating line.

As mentioned, the abrading device 45 is operable to remove dirt and loose scaling from pipe P and to abrade the surface of the pipe for better adherence of the coating material. Furthermore, the oppositely rotating brush pairs ensures that the pipe does not rotate as it is being sprayed thereby preventing any scuffing or gauging of the pipe by conveying equipment which contacts pipe P as it is being moved through the spraying system of the present invention.

OPTIONAL UPSTREAM HEATER

An optional preheat station comprising an upstream heater means 44, which can be identical to the downstream heater means 42, as shown in FIG. 1. It includes a manifold and a plurality of burners directed inwardly toward the pipe P. The manifold is connected to a source of flammable fluid, such as propane, natural gas or a shop gas which, when ignited, produces a flame operable to direct heat toward and onto the pipe P. Such preheat station indicated at 44 is optional and can be used to slightly preheat the surface of the pipe P or to drive any moisture thereon from the pipe.

HEATED HOSES

Reference has been made to various heated hoses. These are heated hoses of any suitable type having electric heating elements therein for maintaining fluids therein at or above a predetermined temperature. The hoses are provided with suitable end fittings or couplings for operative connection to the ports, passages and elements as described herein. One such useful hose is hose model Series II manufactured by Nordson Corporation of Amherst, OH.

CONTROLS

The controls for the valves, hoses, pumps, tanks, heaters, pipe conveyors and associated cooled rollers, abrading mechanism and pre- or post heating means are all conventional. Any suitable control means can be used.

OPERATION

Accordingly, it will be appreciated that as a pipe P is moved in the machine direction MD, it moves through any optional preheat means 44 and through an optional abrading mechanism 45 into the cabinet 18, where coating material is sprayed thereon. It will be appreciated, however, that the pipe is primarily at room or ambient temperature, for example about 70 degrees F. When the liquified coating material, which is at an elevated temperature of approximately between 350 degrees F. to 425 degrees F., sufficient to maintain it in liquified form, engages the much cooler pipe surface, the coating material tends to solidify or partially solidify on the pipe. It will be appreciated that the viscosity of the liquified coating material may also be varied by temperature changes within a desired operating range for the spraying results desired.

The pipe can be moved through the cabinet at any desirable speed. One such speed, as an example, is in the range of approximately 200 feet per minute. The cabinet itself is approximately six feet long, thus the dynamic dwell time of the pipe moving at 200 feet per minute within cabinet 18 is approximately two seconds. Even though the interior surfaces of the cabinet are maintained at a temperature within an approximate range of about 300 degrees F. to about 425 degrees F., the speed of the pipe through the cabinet does not permit the pipe to be significantly heated. Thus, when the coating material is applied to the pipe, or other object being coated, it at least partially solidifies and remains in a partially solidified condition on the pipe as it exits the outlet 71 (FIG. 4). Thereafter, the pipe P is introduced to the downstream heating station exemplified by the heater means 42, This directs heat onto the pipe, such that the solidified and partially solidified coating material on the pipe's surface is liquified, and flows together or coalesces into a uniform coating on the pipe. Again, the pipe is moving through the heater means 42 at approximately 200 feet per minute and the coating material then immediately resolidifies as a uniform coating material on the surface of the pipe P.

The cooled rollers 16 of the present invention ensure that the sprayed layer of coating material on pipe P does not come away from the pipe and stick to the rollers. The cool temperature of the rollers further enhances the solidification of the coating material, and the condensation on the rollers further prevents adherence of material to the rollers.

Of course, during this time the cabinet heating apparatus, as illustrated in FIG. 2, is operated to maintain the cabinet walls at a desired temperature of somewhere in the range between about 300 degrees F. and about 425 degrees F. This assures that the interior cabinet walls will remain at a temperature, such that any overspray of the liquified coating material, in or from the coating space, will run down the walls and onto the heated floor of the cabinet 18. Since the floor is pitched or inclined toward the sump 28, the liquified material will run into heated sump 28 for recombination with any new coating material from the bulk melters 20, 22 and recirculation through the spraying nozzles onto further pipe surfaces.

Accordingly, it will be appreciated that the oversprayed coating material is reclaimed and returned directly to the spray nozzles. Since the coating material is a hot melt type material, there are no deleterious solvents from the spraying operation to handle or to treat. Moreover, when the coating material is applied to the relatively cool pipe, it at least partially solidifies to leave semi-solid particles or globules on the pipe's surface. The post-heating step serves to flow out the coating material onto the pipe to provide a uniform surface, which is highly protective and of relatively long duration when compared with prior pipe varnishes.

It will also be appreciated that, as noted above, other objects can be coated with such apparatus, such as structural steel elements of determinate or indeterminate length and, as well, discreet objects suspended from an overhead conveyor, for example. Of course, the apparatus could be modified to convey and handle such objects and to position the respective spraying nozzles in such a position as to adequately coat such articles in the coating space 78, within the cabinet, all while providing the same advantages as have been described above with respect to the pipe coater. Accordingly, many types of objects can be advantageously coated through the use of the invention.

These and other modifications and alterations will become readily apparent to those of ordinary skill in the art without departing from the scope of this invention and the applicants intend to be bound only by the claims appended hereto:

We claim:

1. A method of applying a coating to a moving object including the steps of:

passing said object through an enclosed coating space, applying a liquified solvent-free coating material, which is normally solid at ambient temperature, from applicators within said space to a surface of said object;

maintaining the temperature of said object such that at least a portion of said applied liquified coating material partially solidifies upon contact with the surface of said object;

maintaining an excess portion of applied coating material not solidifying on the object surface in liquified form for recovery, and heating said partially solidified coating material on said object with a non-contact heater, after its passage through said coating space and liquifying said coating material so that the material flows and forms a continuous coating on said object.

2. A method as in claim 1 including the steps of:

recovering said excess portion of liquified coating material in a liquified state in said coating space; and recirculating said recovered coating material to one or more of said applicators for application to other object surfaces within said coating space.

3. A method as in claim 2 wherein said coating space is defined by housing walls and further including the step of heating said housing walls to maintain oversprayed coating collecting on said walls in a liquified state.

4. A method as in claim 3 wherein the step of heating said housing walls includes the step of passing heated fluid through said walls.

5. A method as in claim 2 wherein said recirculating step includes collecting liquified excess coating material in a heated sump.

6. A method as in claim 5 wherein said recirculating step further includes pumping liquified coating material from said heated sump to one or more of said applicators.

7. A method as in claim 6 including sensing the level of liquified coating material in said heated sump and adding additional liquified coating material into said sump when said level decreases below a predetermined minimum.

8. A method as in claim 1 wherein said coating material is sprayed onto said object through nozzles and further including the step of heating said nozzles.

9. A method as in claim 1 further including the step of heating said object to warm a surface of said object prior to said coating material applying step, the coating material at least partially solidifying on said warmed object surface.

10. A method as in claim 1 including the step of supplying said liquified coating material to said coating space for coating an object from at least two separate coating material supplies and through a switch-over means such that one supply is used while the other is not used.

11. A method as in claim 1 wherein said object is an elongated object.

12. A method as in claim 1 including the step of abrading the object before applying the coating material to provide improved adherence of the coating material to the object.

13. A method as in claim 1 including the step of conveying the object after the coating material is applied on conveyors cooled below the liquification temperature of the coating material to prevent the conveyors from damaging the smooth continuous coating.

14. A method of applying solvent-free coating material which is solid at room temperature to an object, comprising the steps of:

heating said coating material to a liquified state;

supplying said coating material to at least one applicator while the coating material is still in said liquified state;

applying said coating material in a liquified state to said object within an enclosed coating space by spraying the object with said applicator;

maintaining said coating material and overspray coating material from the spraying in a liquified state during said application and maintaining the temperature of said object such that material contacting said object at least partially solidifies upon contact with the surface of said object; and thereafter heating the coated surface of said object with generally non-contact heat to liquify said at least partially solidified coating material and to cause said material to flow together in a continuous coating on the object surface.

15. The method of claim 14 further including the steps of preheating said object to warm the exterior surface of said object prior to the application of said coating material, the coating material at least partially solidifying on said warmed object surface.

16. A method of applying a coating to an object, comprising the steps of:

passing an object through a coating space;

applying a liquified solvent-free coating material, which is normally solid at ambient temperature, to a surface of said object within said coating space by means of one or more applicators disposed within said space;

maintaining the temperature of said object such that at least a portion of said applied liquified material partially solidifies upon contact with said object surface while said material prior to said contact remains liquid;

maintaining an excess portion of the liquified coating material, not solidifying on the object surface, in liquified form within said coating space; and recirculating said maintained excess portion of coating material in liquified form to said one or more applicators for application to other objects or object surfaces within said coating space;

heating said partially solidified coating material on said object surface with a non-contact heater after its passage through said coating space and liquifying said coating material so that the material flows and forms a continuous coating on said object surface.

17. A method of applying a coating to a moving object including the steps of:

passing said object through an enclosed coating space, applying a liquified solvent-free coating material, which is normally solid at ambient temperature, from applicators within said space to a surface of said object, such that at least a portion of said liquified material partially solidifies upon contact with the surface of said object while excess coating material not solidifying on the object surface is maintained in liquified form for recovery, heating said partially solidified coating material on said object after its passage through said coating space to cause said coating material to flow and form a coating on said object; and, abrading the object before applying the coating material to provide improved adherence of the coating material to the object.

18. Apparatus for applying solvent-free coating material which is solid at room temperature to a moving non-textile object, comprising:

a heater for heating the solvent-free coating material to a liquified state;

a housing having an inlet, an outlet and walls defining a coating space therein for receiving a portion of said object passing therethrough between the inlet and outlet;

at least one coating applicator within said coating space for spraying liquified solvent-free coating material onto said portion of the object passing through said coating space;

said housing maintaining the sprayed portion of said object at a temperature such that sprayed coating material partially solidifies on said object portion;

a liquid delivery system for transporting the liquified coating material to said coating applicator located within said housing;

a liquifying system for maintaining oversprayed coating material in a liquid state within said housing;

a reclamation system for returning said oversprayed liquified coating material to said coating applicator; and a post-spray heater positioned proximate the outlet, the post-spray heater spaced from the object and operable for heating said sprayed portion and the partially solidified sprayed coating and causing said coating material to flow together in a continuous coating on the object.

19. The apparatus of claim 19 wherein said liquifying system further includes a heating system for heating said walls for maintaining the oversprayed coating material in a liquid state.

20. The apparatus of claim 14 wherein said housing walls are comprised of inner and outer wall elements having spaces therebetween and further including a circulating system to circulate a heated material through said spaces to heat the walls.

21. The apparatus of claim 18 wherein said reclamation system comprises a sump located in the lower portion of said housing below said coating space and a pump operatively connected to said sump for returning coating material to said applicator.

22. The apparatus of claim 21 wherein said sump includes a sump heater to control the temperature of said coating material in said sump.

23. The apparatus of claim 22 wherein said sump heater comprises a heated platen underlying said sump.

24. The apparatus of claim 21 wherein said heater for heating coating material to a liquid state includes a supply for supplying liquified coating material to said sump.

25. The apparatus of claim 24 including a level control within said sump for controlling said supply to selectively supply liquified coating material to the sump.

26. The apparatus of claim 18 wherein said coating applicator is a heated spray gun.

27. The apparatus of claim 18 wherein said post-spray heater comprises one or more flame burners disposed for directing flames toward said object.

28. The apparatus of claim 18 further including a pre-spray heater disposed outside said inlet for preheating said object to warm the exterior surface of said object prior to the spraying of any coating material thereon while maintaining said object at a temperature for partially solidifying said coating material sprayed thereon.

29. The apparatus of claim 18 wherein said coating applicator is a spray nozzle.

30. The apparatus of claim 18 including at least two separate heaters and supplies for heating said coating material to a liquid state and for supplying said liquified coating material to said coating applicator and further including a switch-over between said supplies so that one of said supplies can be used to supply said coating applicator while the other of said supplies is not being used.

31. The apparatus of claim 18 further comprising a conveyor system with conveying elements to contact the object and convey the object after it has been coated, at least one of the conveying elements cooled to a temperature below the liquifying temperature of the coating material to prevent adhesion of the sprayed coatings material to the element.

32. The apparatus of claim 31 wherein the conveying element has a cooling space defined therein and further including a coolant circulation system for circulating a coolant fluid through the cooling space of the element to cool the element.

33. The apparatus of claims 32 wherein the elements are rollers on which the object rolls after it has been sprayed.

34. The apparatus of claim 31 wherein the temperature of the elements is in the range of approximately 35° F. to 55° F.

35. The apparatus of claim 18 further comprising an abrading device for abrading an outer surface of the object before it is sprayed with liquified solvent-free coating material to promote improved adhesion of the sprayed material to the surface.

36. The apparatus of claim 35 wherein the abrading device includes at least one abrading element and a drive mechanism to move the abrading element against the object and abrade the surface of the object.

37. The apparatus of claim 36 wherein the abrading device includes another abrading element positioned generally opposite the one abrading element to abrade opposite surfaces of the object.

38. The apparatus of claim 37 wherein the abrading elements are moved in opposite directions against the object to offset one another and reduce the motion of the object abraded by the abrading elements.

39. The apparatus of claim 36 wherein the abrading element is a circular brush which is rotated by the drive mechanism to abrade the object.

40. The apparatus claim 36 wherein the abrading element is adjustably mounted to be selectively positioned with respect to said object to abrade a selected surface of the object.

41. The apparatus of claim 18 wherein said post-spray heater provides non-conductive heat to said sprayed coating material for flowing said coating material into a continuous coating.

42. Apparatus for applying solvent-free coating material, which is solid at ambient temperature, to a moving non-textile object, comprising:

a housing defining an enclosed coating space through which said object passes and is therein coated;

a heater for heating the solvent-free coating material to a liquified state;

an applicator inside said coating space for applying said liquified coating material onto a surface of said object within said coating space wherein a portion of said liquified coating material partially solidifies upon contact with the surface of said object;

a liquifying system for maintaining excess applied coating material in said housing in a liquified state except for that partially solidified coating material applied on said object surface, wherein said coating material remains liquid until contacting the surface of said object, and excess applied coating material is maintained in a liquified state for recovery; and a post-application heater disposed outside said coating space and spaced from said object for applying external heat to said partially solidified coating material on said object surface for flowing said coating material into a continuous coating on said object surface.

43. Apparatus as in claim 42 further including a liquid delivery system for supplying liquified coating material to said applicator and for maintaining said coating material in a liquified state prior to application to said object.

44. Apparatus as in claim 43 wherein said liquid delivery system includes a heated sump and a pump for pumping liquified coating material from said sump to said applicator.

45. Apparatus as in claim 44 further including a supply for supplying liquified coating material to said sump, and a coating material level sensor in said sump for controlling said supply for said sump.

46. Apparatus as in claim 43 wherein said liquid delivery system comprises a heated, double acting piston pump.

47. Apparatus as in claim 42 wherein said applicator comprises at least one spray nozzle for spraying liquified coating material onto said object.

48. Apparatus as in claim 42, wherein said housing comprises a plurality of walls, and the liquifying system includes a heating systems for heating said walls to maintain excess applied coating material in a liquified form.

49. Apparatus as in claim 48 wherein said walls are insulated and have spaces adjacent said insulation, said heating system further including an apparatus for pumping heated fluid through said spaces for heating the walls.

50. Apparatus as in claim 42 wherein said applicator comprises at least one bank of coating material spray nozzles disposed about said coating space and staggered with respect to one another for spraying coating material onto said object.

51. Apparatus as in claim 42 wherein said applicator comprises at least two independent and semi-circularly arranged banks of coating material spray nozzles for spraying coating material onto said object, each bank mounted on a semi-circular support, and wherein nozzles of one bank are staggered with respect to nozzles of another bank.

52. Apparatus as in claim 51 wherein said semi-circular supports are movably mounted for selective movement away from and outside said coating space.

53. Apparatus as in claim 42 wherein said applicator comprises a semi-circular bank of coating material spray nozzles mounted on a semi-circular structure wherein the nozzles are staggered with respect to each other.

54. Apparatus as in claim 53 wherein said semi-circular structure is slidably mounted on a guide to be selectively slid outside said coating space.

55. Apparatus as in claim 42 wherein said post-application heater for heating said partially solidified coating material on said object surface is disposed outside said coating space.

56. Apparatus as in claim 42 further including a pre-application heater for externally preheating said object to warm the surface of said object upstream of said coating space prior to the application of any coating material to said object surface while maintaining said object at a temperature for partially solidifying said coating material applied thereon.

57. Apparatus as in claim 42 wherein said post-application heater provides generally non-conductive heat to said partially solidified coating material for flowing said coating material into a continuous coating.

58. Apparatus for applying a non volatile, solvent-free coating material, which is solid at ambient temperature, to an elongated moving tubular shaped object and comprising:

a. a housing defining a coating space having an inlet and outlet thereto, for passage therethrough of said elongated object for coating;

b. coating material spray nozzles disposed within and about said coating space, for spraying said coating material in liquified form onto a portion of said elongated object as it passes through said coating space with said coating material partially solidifying upon application to said object portion in said coating space;

c. a heated supply system for heating said coating material to a liquified state and for supplying liquified coating material to said nozzles said supply system including:

i. a heated sump for receiving liquified coating material from a supply of coating material, ii. a valve for controlling flow of liquified coating material from said supply into said heated sump;

iii. a coating material level detector in said sump for controlling said valve and said flow of liquified coating material from said supply into said sump;

iv. a heated pump for pumping liquified coating material from said sump to said nozzles; and v. heated hoses for conveying liquified coating material from said pump to said nozzles;

d. a heating system coupled to the housing for heating interior walls of said housing defining said coating space to maintain oversprayed coating material, which does not partially solidify on said object portion, in liquified form;

e. a post-spray heater downstream of said coating space and surrounding said tubular shaped objects emerging from said housing outlet, said post-spray heater spaced from the object and externally heating said partially solidified coating material on said object portion to cause said coating material to flow out on said object to provide a continuous coating thereon while the temperature of said elongated object is not significantly raised; and f. said sump operatively disposed with respect to said coating space for receiving oversprayed liquified coating material therefrom for recirculation to said spray nozzles.

59. Apparatus for applying a solvent-free coating material to an elongated object comprising:

a housing having an inlet and an outlet and walls defining a coating space;

a sump;

a heating system for heating said housing walls such that coating material engaging said walls is liquified and flows down said walls toward said sump;

a spraying device for spraying liquified coating material onto a portion of said object in said coating space as said object portion passes therethrough, the liquified coating material engaging said object portion and partially solidifying on a surface of said object portion within said coating space; and a heater device downstream of said outlet encircling a coated object portion emerging from said outlet and spaced from said coated object portion, the heater device operable for heating said coating material as the coated objected passes thereby to liquify said partially solidified material on said object portion for coating said object portion with a continuous coating of material.

60. Apparatus as in claim 59 wherein said heater device downstream of said outlet, comprises a series of gas burners disposed in a circle about said object portion for heating said object without physical contact therewith.

61. Apparatus as in claim 59 wherein said wall heating system is also operable for maintaining all coating material in said coating space in a liquified state except for the partially solidified coating material on said object portion in said coating space.

* * * * *

UNITED STATES PATENT AND TRADEMARK OFFICE

CERTIFICATE OF CORRECTION

PATENT NO. : 5,585,143

DATED : December 17, 1996

INVENTOR(S) : Donald R. Scharf, Douglas J. Conrad, and Kenneth J. Coeling

It is certified that error appears in the above-identified patent and that said Letters Patent is hereby corrected as shown below:

In Column 6, line 23, delete "are" following 60,61.

In Column 6, line 52, delete "he" and insert --the--.

In Column 14, line 44, delete "if" and insert --is--.

In Column 15, lines 10 and 11, delete "layer 246. Since" and insert --layer 246, since--.

In Column 15, line 16, delete "roll 230" and insert --of roller 230--.

In Column 21, in claim 20, delete "of claim 14" and insert --of claim 19--.

UNITED STATES PATENT AND TRADEMARK OFFICE

CERTIFICATE OF CORRECTION

PATENT NO. : 5,585,143
DATED : December 17, 1996
INVENTOR(S) : Donald R. Scharf, Douglas J. Conrad, and Kenneth J. Coeling It is certified that error appears in the above-identified patent and that said Letters Patent is hereby corrected as shown below:

In Column 22, in claim 33, delete "of claims 32" and insert --of claim 32--.

In Column 22, in claim 40, insert --of— after "apparatus."

In Column 23, in claim 48, line 37, delete "systems" and insert --system--.

In Column 24, in claim 57, line 9, delete "generally".

In Column 25, in claim 59, line 9, delete "objected" and insert --object--.

Signed and Sealed this

Twenty-sixth Day of May, 1998

Bruce Lehman

*Attest:*

BRUCE LEHMAN

*Attesting Officer*

*Commissioner of Patents and Trademarks*